US009051141B2

(12) United States Patent
Kato

(10) Patent No.: US 9,051,141 B2
(45) Date of Patent: Jun. 9, 2015

(54) SHEET CONVEYING APPARATUS

(75) Inventor: Shinobu Kato, Chichibu (JP)

(73) Assignee: Canon Denshi Kabushiki Kaisha, Chichibu-shi (JP)

( * ) Notice: Subject to any disclaimer, the term of this patent is extended or adjusted under 35 U.S.C. 154(b) by 0 days.

(21) Appl. No.: 14/009,386

(22) PCT Filed: Apr. 5, 2012

(86) PCT No.: PCT/JP2012/059377

§ 371 (c)(1),
(2), (4) Date: Oct. 2, 2013

(87) PCT Pub. No.: WO2012/137871

PCT Pub. Date: Oct. 11, 2012

(65) Prior Publication Data

US 2014/0021679 A1 Jan. 23, 2014

(30) Foreign Application Priority Data

Apr. 8, 2011 (JP) ..... 2011-086723
Apr. 8, 2011 (JP) ..... 2011-086724

(51) Int. Cl.
*B65H 3/52* (2006.01)
*B65H 3/06* (2006.01)
(Continued)

(52) U.S. Cl.
CPC ..... *B65H 3/0676* (2013.01); *B65H 1/022* (2013.01); *B65H 3/0661* (2013.01);
(Continued)

(58) Field of Classification Search
CPC ..... B65H 3/52; B65H 3/56; B65H 3/5261; B65H 3/46; B65H 1/12; B65H 3/06
USPC ..... 271/121–127
See application file for complete search history.

(56) References Cited

U.S. PATENT DOCUMENTS 5,552,859 A 9/1996 Nakagawa et al.
5,725,208 A * 3/1998 Miyauchi ..... 271/10.09
(Continued)

FOREIGN PATENT DOCUMENTS

JP H3-62031 U 6/1991
JP 10-181921 A 7/1998
(Continued)

OTHER PUBLICATIONS

International Search Report issued in International Application No. PCT/JP2012/059377 dated Jun. 19, 2012.

*Primary Examiner* — Ernesto Suarez
(74) *Attorney, Agent, or Firm* — Fitzpatrick, Cella, Harper & Scinto

(57) ABSTRACT

A sheet conveying apparatus includes an intermediate plate (21*b*) as a sheet receiving member configured to stack a sheet, a feed roller (22) as a feed rotator configured to feed the sheet stacked on the intermediate plate (21*b*), and a separation roller (23) as a separation member configured to separate the sheet from a sheet bundle stacked on the intermediate plate (21*b*). The sheet conveying apparatus further includes a restrict member (60) as a restrict portion disposed so as to reach a position overlapped in a width direction orthogonal to a sheet conveying direction with the feed roller (22) as at least one member among the feed roller (22) and the separation roller (23) and offset in the width direction from the feed roller (22), and restricting a leading end position of the sheet stacked on the intermediate plate (21*b*). This arrangement enables to improve sheet conveying performance because the restrict member (60) can restrict the leading end position of the sheet stacked on the intermediate plate (21*b*).

17 Claims, 20 Drawing Sheets

(51) Int. Cl.
*B65H 1/02* (2006.01)
*B65H 3/56* (2006.01)
*B65H 5/06* (2006.01)

(52) U.S. Cl.
CPC ..... *B65H 3/5261* (2013.01); *B65H 3/56* (2013.01); *B65H 2402/441* (2013.01); *B65H 2402/46* (2013.01); *B65H 5/06* (2013.01)

(56) References Cited

U.S. PATENT DOCUMENTS 6,059,281 A * 5/2000 Nakamura et al. ..... 271/119
6,086,062 A * 7/2000 Nakamura et al. ..... 271/121
6,536,759 B1 3/2003 Takada
6,547,237 B2 * 4/2003 Sugino et al. ..... 271/119
7,040,614 B2 * 5/2006 Sonoda et al. ..... 271/125
7,731,178 B2 * 6/2010 Miyake et al. ..... 271/121
2008/0217839 A1 * 9/2008 Bingham et al. ..... 271/121

FOREIGN PATENT DOCUMENTS

JP 2000-177854 B2 6/2000
JP 2001-163472 A 6/2001
JP 3624108 B2 12/2004
JP 2005-035735 A 2/2005
JP 2007-045634 A 2/2007

* cited by examiner

SHEET CONVEYING APPARATUS

TECHNICAL FIELD

The present invention relates to a sheet conveying apparatus configured to convey a sheet provided between a sheet receiving member and a feed rotator.

BACKGROUND ART

Conventionally, a document information reading apparatus such as a scanner, and an image forming apparatus such as a copier, a printer, a facsimile machine and a multi-function printer are provided respectively with a sheet conveying apparatus for conveying a sheet to an information reading portion or an image forming portion. The information reading portion is a part provided with a sensor such as an image sensor that reads image information on the sheet or a sensor that reads magnetic information of the sheet. The image forming portion is a part that forms an image on the sheet by an ink dot type apparatus, an electro-photographic type apparatus, an electrostatic recording type apparatus, or the like. The sheet conveying apparatus includes a tray on which a sheet is stacked and a feed roller disposed so as to face the tray and configured to feed the sheet on the tray into the apparatus.

In order to convey the sheet as described above, it is necessary to nip the sheet by an intermediate plate (sheet receiving member) which is a part of the tray and the feed roller. To that end, the sheet conveying apparatus is provided with a spring that biases the rotatably supported intermediate plate toward the feed roller to nip the sheet between the intermediate plate and the feed roller by a bias force of the spring for example. The sheet conveying apparatus is also provided with a separation roller for separating a sheet one by one from a bundle of sheets at a location facing the feed roller downstream in a sheet conveying direction of the intermediate plate. The separation roller rotates in a direction opposite from that of the feed roller and moves the sheet in a direction opposite from the sheet conveying direction (see Patent Literature 1).

CITATION LIST

Patent Literature

[PTL 1] Japanese Patent No. 3624108

SUMMARY OF THE INVENTION

Technical Problem

It is desired to improve performance for conveying a sheet stacked on the intermediate plate of the configuration including the feed roller, the separation roller, and the intermediate plate as described above.

Solution to Problem

A sheet conveying apparatus of the present invention includes a sheet receiving member on which a sheet is stacked, a feed rotator for feeding the sheet stacked on the sheet receiving member, a separation member for separating the sheet from a sheet bundle stacked on the sheet receiving member, and a restrict portion disposed so as to reach a position where the restrict portion is overlapped in a width direction orthogonal to a sheet conveying direction with at least one member among the feed rotator and the separation member and where the restrict portion is offset in the width direction from the one member, and restricting a leading end position of the sheet stacked on the sheet receiving member.

Specifically, the sheet receiving member is movably supported by a case, and the separation member comes into contact with the feed rotator and forms a nip portion, the sheet conveying apparatus further includes a moving portion that moves the sheet receiving member between a feed position where the sheet stacked on the sheet receiving member is bought into contact with the feed rotator and a standby position distant from the feed rotator more than the feed position, and an abut portion fixed to the case and disposed between the sheet receiving member and the nip portion such that a leading end of the sheet stacked on the sheet receiving member abuts against the abut portion in the standby position, wherein the restrict portion includes a restrict member that projects from the abut portion to a position where the restrict member is overlapped in the width direction orthogonal to the sheet conveying direction with the feed rotator and where the restrict member is offset in the width direction from the feed rotator, and wherein the restrict member restricts, together with the abut portion, a sheet bundle stacked on the sheet receiving member in the standby position from entering the nip portion, and is brought into contact with a sheet to be conveyed by the feed rotator in the feed position to send the sheet while deflecting the sheet.

More specifically, the separation member is a separation rotator disposed downstream in the sheet conveying direction of the feed rotator of the sheet receiving member through an intermediary of a gap with the sheet receiving member and configured to move the sheet in a direction opposite from the sheet conveying direction to separate the sheet one by one from the sheet bundle on the sheet receiving member, and wherein the restrict portion includes a projection member that projects through the gap from the downstream end in the sheet conveying direction of the sheet receiving member to a position where the project member is overlapped in the width direction orthogonal to the sheet conveying direction with the separation rotator and where the project member is offset in the width direction from the separation rotator.

Advantageous Effects of the Invention

The invention makes it possible to improve sheet conveying performance because the leading end position of the sheet stacked on the sheet receiving member is restricted by the restrict portion.

Specifically, the restrict portion has the restrict member that projects from the abut portion to the position superimposing in the width direction with the feed rotator and the abut portion and the restrict member restrict a sheet bundle from entering the nip portion in the standby position, so that a part of the sheet bundle stacked on the sheet receiving member is hard to enter the nip portion in a layered condition even if the sheet bundle stacked on the sheet receiving member is pushed in. Still further, the sheet is sent to the nip portion in a condition in contact with and deflected by the restrict member, the sheet can be separated easily from the sheet bundle. Due to that, it is possible to suppress sheets otherwise fed in the layered condition without strictly restricting the gap between the abut portion and the feed rotator. Still further, because the restrict member projects from the edge of the abut portion and is overlapped only in the width direction with the feed rotator, the apparatus is not enlarged and, coupled with the unnecessity of strictly restricting the gap between the abut portion and the feed rotator, it is possible to prevent an increase in cost. As a result, it is possible to obtain the configuration that can suppress sheets otherwise fed in the layered condition without enlarging the apparatus at low cost.

More specifically, the project member of the restrict portion is formed to the position overlapped in the width direction with the separation rotator and offset in the width direction from the separation rotator through the gap from the downstream end in the sheet conveying direction of the sheet receiving member, so that it is possible to prevent a part of the sheets from entering the gap. As a result, it is possible to convey sheets stably while suppressing the sheet from being jammed or skewed.

BRIEF DESCRIPTION OF THE DRAWINGS

FIGS. 6*a* and 6*b* are perspective views of an excerpted configuration for moving an intermediate plate, wherein FIG. 6*a* illustrates a feed position, and FIG. 6*b* illustrates a stand by position, respectively.

DESCRIPTION OF THE EMBODIMENTS

First Embodiment

A first embodiment of the invention will be explained with reference to FIGS. 1 through 8.

[Document Information Reading Apparatus]

Figure 1:
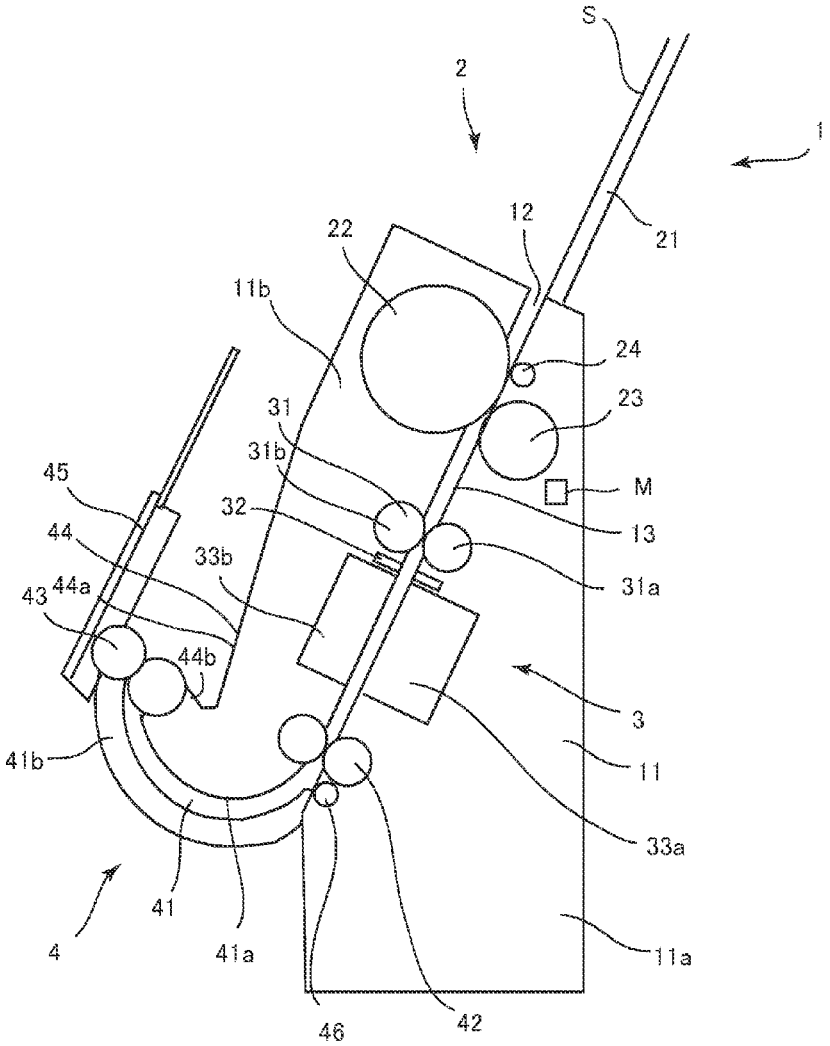
FIG. 1 is a schematic section view of a configuration of a document information reading apparatus including a sheet conveying apparatus of a first embodiment of the invention.

An overall configuration of a document information reading apparatus, i.e., a subject of the present invention, will be briefly explained first. As shown in FIG. 1, the document information reading apparatus (referred to simply as a scanner hereinafter) 1 includes a sheet feeding portion 2, i.e., a sheet conveying apparatus, an information reading portion 3 configured to read information on a sheet, and a discharge portion 4 configured to discharge the sheet. The scanner 1 reads image information on the sheet fed from the sheet feeding portion 2 by the information reading portion 3 and discharges the sheet from which information has been read by the discharge portion 4. The scanner 1 is arranged so as to convey a sheet by making an angle for conveying the sheet closer to a vertical direction in order to reduce an installation area of the apparatus.

The sheet conveying apparatus, i.e., the sheet feeding portion described above, includes a tray configured to stack a sheet and a feed roller disposed so as to face the tray, and feeds the sheet on the tray into the apparatus by the feed roller. If a bundle of sheets is pushed into a side of a nip portion between the feed roller and a separation roller too much in stacking the sheet bundle on the tray arranged as described above, a part of the sheet bundle tends to enter the nip portion and to be fed in a condition in which the sheets are layered with each other. In order to deal with such circumstance, there is known a configuration in which a rockable return lever is provided upstream in a sheet conveying direction of the nip portion. This configuration prevents a part of the sheet bundle from entering the nip portion in such a layered condition in stacking the sheet bundle on the tray by abutting a leading end of the sheet bundle against the return lever which is rocked so as to close a gap between the tray and the nip portion. Meanwhile, the return lever is rocked such that the lever recedes from the gap between the tray and the nip portion to permit the sheet to pass through the nip portion in conveying the sheet to the nip portion (see Japanese Patent Application Laid-open No. H10-181921).

There is also known a configuration in which a separation guide is provided upstream in a sheet conveying direction of a nip between a feed roller and a separation roller so as to have a predetermined gap with the feed roller. This configuration prevents sheets from being fed in the layered condition by limiting a quantity of sheets that can pass through the gap by restricting the predetermined gap (see Japanese Patent Application Laid-open No. 2005-35735).

The configuration described above in Japanese Patent Application Laid-open No. H10-181921 requires the movable return lever, so that parts for driving the return lever are also required. Accordingly, such configuration increases a production cost, requires a space for installing such parts, and enlarges the apparatus.

The configuration described above in Japanese Patent Application Laid-open No. 2005-35735 is unable to fully suppress the sheets fed in the layered condition or tends to cause jamming of the sheets unless the gap between the feed roller and the separation guide is strictly restricted. Accordingly, because it is necessary to increase accuracies of form and assembly of the feed roller and the separation guide, it is inevitable to increase the production cost.

Note that it is hard for the arrangement as described in Japanese Patent Application Laid-open No. 2005-35735 to deal with conveyance of a thin sheet having a large width such as a plain sheet and with conveyance of a thick sheet such as a plastic card which is undeflectable, thick and whose width is small as compared to the plain sheet. That is, although it is necessary to increase the gap between the feed roller and the separation guide in order to convey such thick sheet, it is unable to adequately limit the quantity of sheets by the gap in conveying a plain sheet and to fully prevent the sheets from being conveyed in the layered condition by the gap if the gap is increased. If the abovementioned gap is reduced to the size corresponding to the plain sheet in contrary, it is unable to convey the thick sheet.

In view of such circumstances, the present embodiment aims at realizing a configuration which enables to suppress such sheets otherwise fed in the layered condition without enlarging the apparatus at low cost. The embodiment will be specifically explained below.

[Sheet Conveying Apparatus (Sheet Feeding Portion)]

The sheet feeding portion 2 is disposed at an upper part of an apparatus body 11 of the scanner 1 and includes a feed roller 22, i.e., a feed rotator, a tray 21 disposed so as to face the feed roller 22 to stack a sheet, a separation roller 23, i.e., a separation member, and a roller 24, i.e., a low-friction member.

Figure 2:
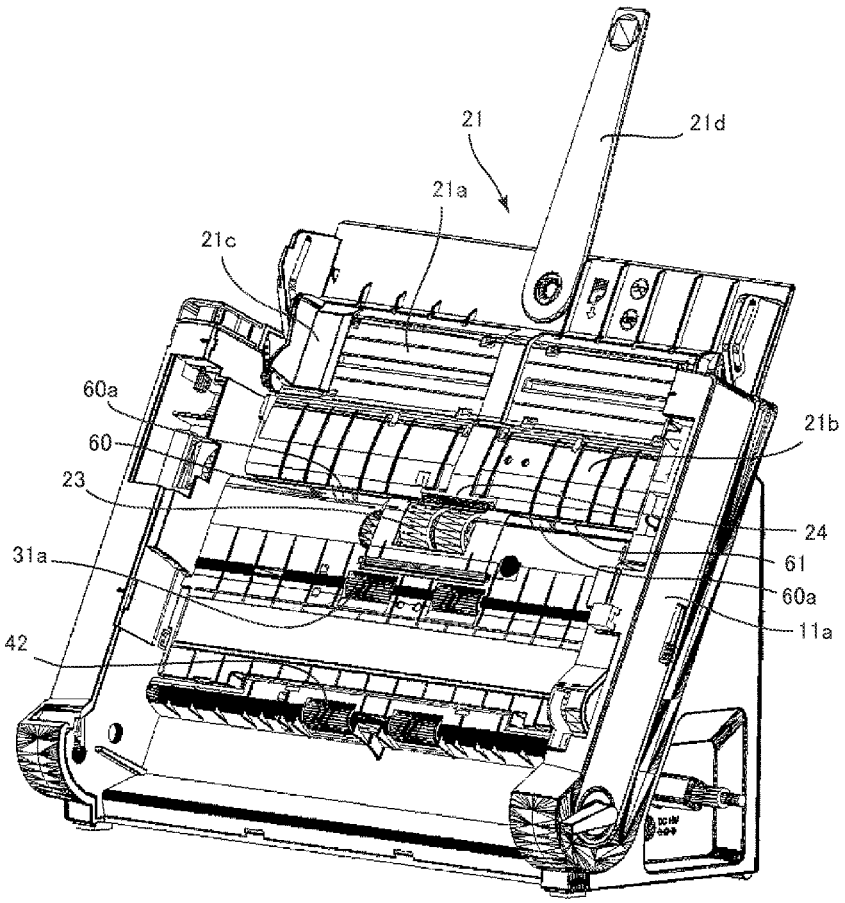
FIG. 2 is a perspective view showing a condition in which a cover portion of the document information reading apparatus of the present embodiment is removed.
Figure 4:
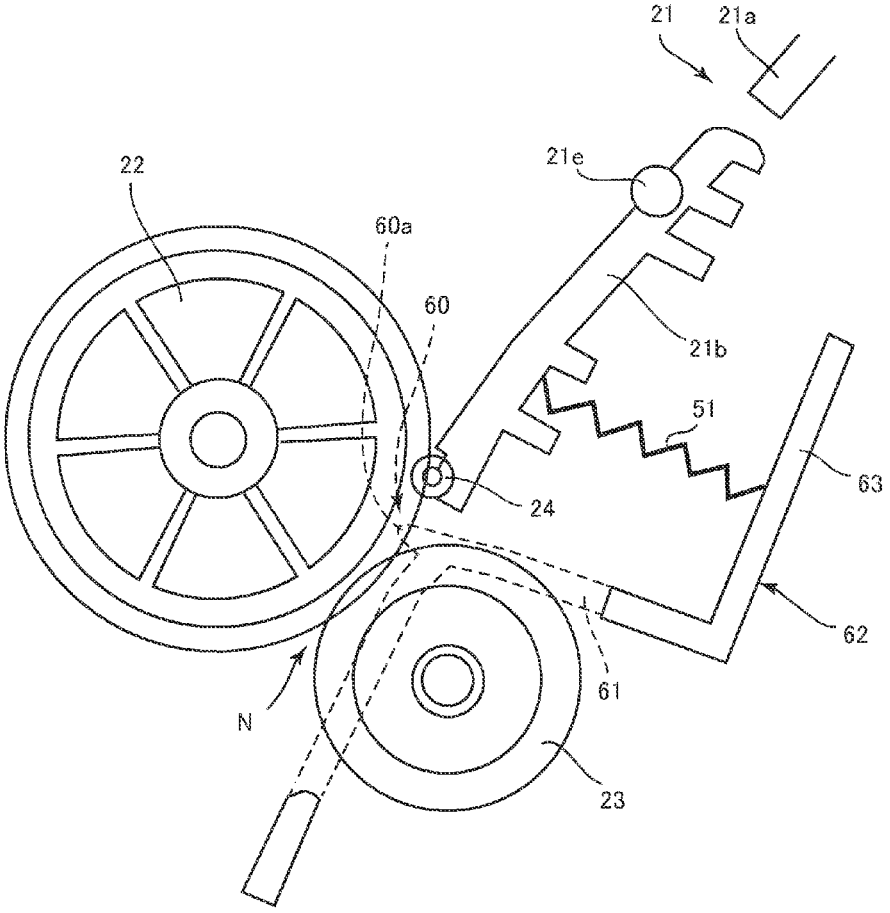
FIG. 4 is a schematic enlarged section view of a part of the document information reading apparatus shown in FIG. 1.
Figure 5:
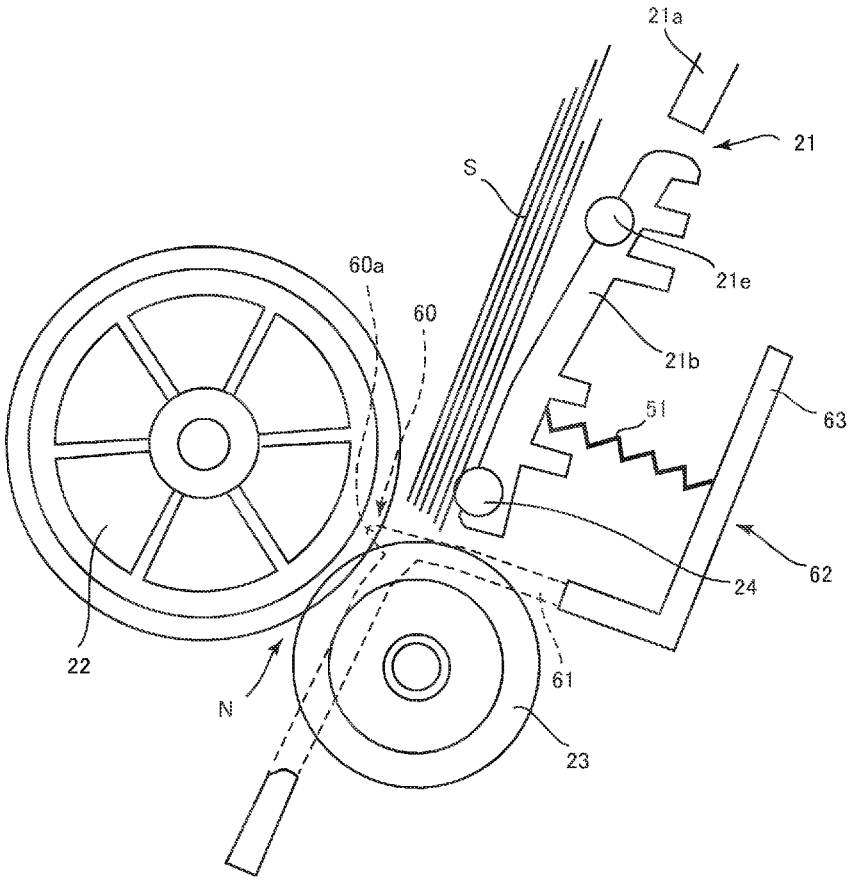
FIG. 5 is a schematic enlarged section view, similar to FIG. 4, showing a condition in which sheets are mounted on a tray.

As shown in FIGS. 2, 4 and 5, the tray 21 is composed of a stationary plate 21*a* fixed to a body portion (case) 11*a* of the apparatus body 11 and a intermediate plate 21*b*, i.e., a sheet receiving member, supported rotatably (movably) with respect to the body portion 11*a*. The tray 21 has an inclination angle close to the vertical direction and is disposed such that weight of a sheet on the tray 21 acts in a direction approaching the separation roller 23 described later when the apparatus is operative. Due to that, the stationary plate 21*a* is provided such that it extends obliquely upward from a sheet feeding opening 12 (see FIG. 1) provided at an upper part of the apparatus body 11.

Still further, a slide member 21*c* is provided on a surface of the stationary plate 21*a* on which a sheet is stacked movably in a width direction (in a front-back direction in FIGS. 1, 4 and 5) as shown in FIG. 2. The slide member 21*c* is configured to be movable corresponding to a sheet size so that a widthwise position of the stacked sheet can be restricted.

A narrow plate-like rotary supporting portion 21*d* is provided at an upper end of the stationary plate 21*a* as shown in FIG. 2 to be able to change a sheet supporting area. That is, a base end portion of the rotary supporting portion 21*d* is supported rotatably at a widthwise intermediate part of the upper end portion of the stationary plate 21*a*. Then, the rotary supporting portion 21*d* is rotated so that it extends obliquely upward from the upper end portion of the stationary plate 21*a* as shown in FIG. 2 in stacking a sheet. When no sheet is stacked in contrary, the apparatus can be made compact by folding the rotary supporting portion 21*d* by rotating by 90 degrees from the condition shown in FIG. 2.

The intermediate plate 21*b* is a plate-like member composed of a steel plate or synthetic resin and is disposed downstream, in the sheet conveying direction (obliquely downward in FIGS. 4 and 5) determined by the feed roller 22, of the stationary plate 21*a*. The intermediate plate 21*b* is rotatably supported by the apparatus body 11 by fitting projections 21*e* (see FIGS. 4 and 5) provided at widthwise both ends thereof to supporting holes provided through the apparatus body 11. These projections 21*e* and the supporting holes compose rotation supporting portions.

A spring 51, i.e., a sheet receiving member biasing means, is disposed between the intermediate plate 21*b* and the apparatus body 11 as shown in FIGS. 4 and 5. The spring 51 is in contact elastically with a back surface of the intermediate plate 21*b* opposite from a front surface on which a sheet is stacked and biases the intermediate plate 21*b* toward the feed roller 22 as shown in FIG. 4. A biasing force of the spring 51 is determined design-wise such that the sheet can be nipped and conveyed by a roller 24 provided on the intermediate plate 21*b* as described later and the feed roller 22.

The intermediate plate 21*b* configured as described above rotates (moves) with respect to the apparatus body 11 centering on the rotation supporting portions by a intermediate plate moving apparatus 50, i.e., a moving portion, described later. Specifically, the intermediate plate 21*b* is movable between a feed position where the intermediate plate 21*b* approaches the feed roller 22 and a sheet can be conveyed by the feed roller 22 and a standby position where the intermediate plate 21*b* is distant from the feed roller 22 more than that in the feed position and a sheet can be stacked.

The sheet stacked on the tray 21 is brought into contact with (pressed to) the feed roller 22 in the feed position shown in FIG. 4. This operation makes it possible to convey the sheet by the feed roller 22 by nipping the sheet by the intermediate plate 21*b* and the feed roller 22. Meanwhile, a gap is formed between the intermediate plate 21*b* and the feed roller 22 in the standby position shown in FIG. 5, so that a sheet (or a bundle of sheets) S can be stacked on the tray 21.

Thus the intermediate plate 21*b* is moved to the standby position to provide the gap between the intermediate plate 21*b* and the feed roller 22 due to the following reason. That is, if the intermediate plate 21*b* is kept biased toward the feed roller 22, a leading end of the sheet (or the sheet bundle) S is hard to enter between the intermediate plate 21*b* and the feed roller 22 in stacking the sheet on the tray 21. Accordingly, the intermediate plate 21*b* is lowered to create the gap between the intermediate plate 21*b* and the feed roller 22 in the present embodiment. This arrangement makes it possible to smoothly convey the sheet by the feed roller 22 by making the leading end of the sheet easily enter the gap between the intermediate plate 21*b* and the feed roller 22 in stacking the sheet (or the sheet bundle) on the tray 21.

The feed roller 22 is provided on a cover portion 11*b* of the apparatus body 11 and is rotationally driven by a motor, i.e., a driving source, not shown. The feed roller 22 comes into contact with the sheet on the intermediate plate 21*b* (on the sheet receiving member) and feeds (conveys) the sheet toward the information reading portion 3. The feed roller 22 is located at a position facing to a widthwise center portion of the tray 21 in the present embodiment.

A separation roller 23 is provided at a position downstream in the sheet conveying direction of the feed roller 22 of the tray 21 and facing to the feed roller 22. The separation roller 23 is disposed so as to come into contact with the feed roller 22 and to form a nip portion N (see FIGS. 4 and 5).

The separation roller 23 constructed as described above is supported movably (rockably) in a direction approaching to/separating from the feed roller 22 and is biased in a direction of approaching to the feed roller 22 by a spring not shown. The separation roller 23 is rotationally driven by a motor M (see FIG. 1), i.e., a driving source, in a direction opposite from a rotational direction (sheet conveying direction) of the feed roller 22. The separation roller 23 makes it possible to easily separate a sheet to be conveyed from other sheets by generating a sheet resistance that acts in the direction opposite from the sheet conveying direction by rotating in the direction opposite from the rotational direction of the feed roller 22 in conveying the sheet by the feed roller 22. It is noted that the separation roller 23 is provided with a torque limiter so that transmission of power from the motor can be cut off when an excessive torque is applied to the separation roller 23.

A positional relationship in the sheet conveying direction of the feed roller 22 and the separation roller 23 is set such that the feed roller 22 is shifted upstream in the sheet conveying direction by the feed roller 22 more than the separation roller 23. This arrangement makes it possible to readily pick up a sheet on the tray 21.

The roller 24, i.e., the low-friction rotational member, is rotatably supported at a front end portion of the intermediate plate 21*b* (a lower end portion or a downstream end portion in the sheet conveying direction of the intermediate plate 21*b* in FIGS. 5 and 6). That is, the roller 24 is disposed on the intermediate plate 21*b* side (on the sheet receiving member side) at a position facing the feed roller 22 so as to be able to nip a sheet with the feed roller 22.

The roller 24 is also supported rotatably with respect to the intermediate plate 21*b* such that a coefficient of friction is lowered than that at positions of the intermediate plate 21*b* other than the position of the intermediate plate 21*b* where the roller 24 is installed (other than the position where the roller 24 faces the feed roller 22). That is, the roller 24 is composed of synthetic resin such as polyacetal (POM) whose surface coefficient of friction is small and is provided with small diameter portions 24*b* integrally formed on both ends of a columnar large diameter portion 24*a* as shown in detail in FIG. 3. These small diameter portions 24*b* (rotational shaft) on the both ends are rotatably supported by support portions 24*c* and 24*d* formed on the intermediate plate 21*b*. Accordingly, the roller 24 is rotatably centering on the rotational shaft.

In the present embodiment, the support portions 24*c* and 24*d* of the intermediate plate 21*b* are also composed of synthetic resin such as POM whose surface coefficient of friction is small. Accordingly, the small diameter portion 24*b* rotates with respect to the support portions 24*c* and 24*d* with a small coefficient of friction. The small diameter portion 24*b*, i.e., the rotational shaft, is disposed in the width direction intersecting (orthogonal in the present embodiment) the sheet conveying direction of the feed roller 22. Therefore, the roller 24 rotates in a direction along the sheet conveying direction when a sheet is conveyed.

One support portion 24*c* among the support portions 24*c* and 24*d* supports the small diameter portion 24*b* so as to pinch by a pair of claws. To that end, the pair of claws is formed so as to project from the surface of the intermediate plate 21*b* toward the feed roller 22 and such that a width of a gap between edges of the pair of claws is slightly smaller than a diameter of the small diameter portion 24*b*. The pair of claws is also formed such that a cylindrical gap whose diameter is slightly larger than that of the small diameter portion 24*b* is formed at an intermediate part of the pair of claws.

The other support portion 24*d* is formed to be a cylindrical portion having an inner diameter which is slightly larger than the diameter of the small diameter portion 24*b*. The small diameter portion 24*b* is inserted into the cylindrical portion so that it is supported by the support portion 24*d*.

In attaching the roller 24 to the support portions 24*c* and 24*d*, the roller 24 is inclined first with respect to the intermediate plate 21*b* and is inclined in a direction in parallel with the surface of the intermediate plate 21*b* while inserting one small diameter portion 24*b* into the other support portion 24*d*. Then, the small diameter portion 24*b* on the opposite side is pressed on the gap portion between the edges of the pair of claws of the one support portion 24*c*. Thereby, the gap between the edges of the pair of claws is elastically widened and the small diameter portion 24*b* enters the middle part of the pair of claws. As a result, the small diameter portions 24*b* at the both ends are supported by the support portions 24*c* and 24*d*, respectively.

In a case of taking the roller 24 out of the support portions 24*c* and 24*d*, the small diameter portion 24*b* on the opposite side is lifted to remove from the gap between the pair of claws of one support portion 24*c*, and the small diameter portion 24*b* on one side is pulled out of the other support portion 24*d*.

The roller 24 thus supported comes into contact with the feed roller 22 in a condition in which the intermediate plate 21*b* is moved to the feed position. Due to that, a force acting on the roller 24 acts in a direction of pressing the small diameter portion 24*b* into one support portion 24*c*. Accordingly, the roller 24 does not come off during operation even if one support portion 24*c* is constructed as described above. It is noted the other support portion 24*d* may be constructed in the same manner with the support portion 24*c*.

It is noted that the surface coefficient of friction itself of the roller 24 described above may not be small so much. That is, the roller 24 may be a rotary member that rotates like a roller and whose coefficient of friction with a counter member is lowered. Accordingly, the roller 24 described above may be a rubber roller in which rubber is wound around a core metal. A coefficient of friction between the rubber roller and a counter member is lowered as a result as long as the core metal is rotatably supported to the intermediate plate 21*b* and a coefficient of friction of rotation supporting portions is small.

Although the roller 24 is defined as the rotary member in the present embodiment, the shape of the rotary member is not limited to that. For instance, the rotary member may be a ball-like member, or may be provided with projections and grooves on a surface thereof.

The provision of the roller 24 at the front edge portion of the intermediate plate 21*b* makes it possible to lower noise otherwise generated in conveying a sheet by the feed roller 22 by lowering a friction with the sheet. The roller 24 also makes it possible to improve the sheet conveying performance because it lowers sliding friction in conveying the sheet. Still further, the roller 24 makes it possible to readily return the sheet bundle on the intermediate plate 21*b* in separating and conveying the sheet from the sheet bundle by the separation roller 23. That is, the roller 24 makes it possible to readily return the sheet bundle because the roller 24 can lower a coefficient of friction between the sheet bundle and the intermediate plate 21*b*. As a result, the roller 24 can prevent the sheet from deflecting, jamming or bending in returning the sheet bundle by the separation roller 23. Still further, the roller 24 can suppress the sheets that are otherwise fed in the layered condition because the roller 24 enables the sheet bundle to be returned readily. The bias force of the spring 51 is set at a required minimum pressing force for picking up a sheet so that the sheet can be readily returned.

The sheet feeding portion 2 of the present embodiment is also provided with a abut portion 61 against which a downstream end (front end) in the sheet conveying direction of the sheet S stacked on the intermediate plate 21*b* abuts when the intermediate plate 21*b* is moved to the standby position. That is, the abut portion 61 appears when the intermediate plate 21*b* moves from the feed position to the standby position and a posture of feed of the sheet S is kept by a corner between the intermediate plate 21*b* and the abut portion 61 by abutting the leading end of the sheet bundle S against the abut portion 61. The abut portion 61 also has a role of preventing the sheet stacked on the intermediate plate 21*b* in the standby position from moving (entering) to the feed roller 22 side (conveying member side) in the present embodiment.

As shown in FIGS. 4 and 5, the abut portion 61 is a part of a crank-like fixing member 62 formed integrally with the body portion (case) 11*a* of the apparatus body 11 or fixed to the body portion 11*a*, and is located in the vicinity of the separation roller 23. Specifically, the abut portion 61 is provided so as to be substantially orthogonal to an upper surface of the intermediate plate 21*b* when the intermediate plate 21*b* is located in the standby position between the intermediate plate 21*b* and the nip portion N of the feed roller 22 and the separation roller 23. That is, when the nip portion N is seen from the top of the intermediate plate 21*b*, the abut portion 61 is hidden by the intermediate plate 21*b* when the intermediate plate 21*b* is located in the feed position and the abut portion 61 is exposed (appears) when the intermediate plate 21*b* moves to the standby position.

With this arrangement, the abut portion 61 is hidden behind the intermediate plate 21*b* without interfering the sheet S stacked on the intermediate plate 21*b* when the intermediate plate 21*b* is located in the feed position, so that the sheet S moves to the feed roller 22 side by the feed roller 22. When the intermediate plate 21*b* is located in the standby position in contrary, the abut portion 61 is exposed at the downstream in the sheet conveying direction of the intermediate plate 21*b* and the downstream end in the sheet conveying direction of the sheet S stacked on the intermediate plate 21*b* abuts against the abut portion 61. Thereby, the sheet bundle is aligned and the sheet S stacked on the tray 21 installed aslant is positioned as described above.

The abut portion 61 is also provided with a restrict member 60, i.e., a restrict portion, that partially projects to an opening side of the conveying path 13 such that the restrict member 60 restricts the sheet S stacked on the intermediate plate 21*b* from entering the conveying path (opening) in the present embodiment. Such restrict members 60 are provided respectively in response to both ends of the nip portion N formed by the feed roller 22 and the separation roller 23. Each restrict member 60 is also provided such that the restrict member 60 projects from the abut portion 61 and reaches to a position (at position not contacting with the feed roller) where the restrict member 60 is overlapped in the width direction orthogonal to the sheet conveying direction with the feed roller 22, i.e., at least one member among the feed rotator and the separation member, and where the restrict member 60 is offset in the width direction from the feed roller 22. In other words, the restrict member 60 overlaps partially with the feed roller 22 when viewed from an axial direction of the feed roller 22. That is, the restrict member 60 is overlapped with the feed roller 22. The restrict member 60 disposed as described above restricts the leading end position of the sheet stacked on the intermediate plate 21*b*.

A surface of the restrict member 60 against which the sheet stacked on the intermediate plate 21*b* abuts is continuously formed with the surface of the abut portion 61 against which the sheet stacked on the intermediate plate 21*b* abuts in the present embodiment. In other words, the abutment surface of the abut portion 61 against which the sheet S abuts is provided to compose a continuous surface with the upper surface of the restrict member 60. Therefore, the upper surface of the restrict member 60 is partially a surface that receives the leading end of the sheet S. Then, the sheet bundle stacked on the intermediate plate 21*b* in the standby position is restricted (suppressed) from entering the nip portion N by the abut portion 61 and the restrict member 60 when the sheet bundle is pushed strongly into the nip portion N. In conjunction with that, the sheet to be conveyed by the feed roller 22 in the feed position is sent to the nip portion N in a deflected condition by being in contact with the restrict member 60.

It is noted that the shape and size of the restrict member 60 are not specifically limited as long as they do not substantially hamper the sheet S from entering the nip portion N in feeding the sheet S for example. For instance, the restrict member 60 is composed of a pair of restrict elements 60*a* as follows. The pair of restrict elements 60*a* is then formed such that surfaces thereof facing with each other in the width direction of the elements 60*a* are tapered in a direction in which the closer to the front end thereof, the wider the space therebetween is. In other words, the sides facing with each other of the elements composing the restrict member 60, i.e., the ends closer to the nip portion N, may be cut away and tapered. This arrangement enables the sheet S to readily enter the nip portion N by receiving a rotational force of the feed roller 22 in the deflected condition. This arrangement also makes a sheet passing through the space between the pair of restrict elements 60*a* be hardly caught by the ends close to the nip portion N of the pair of restrict elements 60*a* by tapering the ends close to the nip portion N of the pair of restrict elements 60*a*. That is, if the ends close to the nip portion N of the pair of restrict elements 60*a* are in parallel with each other, ends of a sheet whose width is slightly smaller than the space between the pair of restrict elements 60*a* and passing through the space tend to come into contact with and to be caught by the ends close to the nip portion of these restrict elements 60*a*. Then, there is a possibility that the end of the sheet is torn. However, it is possible to prevent the end of the sheet from being caught and torn by tapering the ends close to the nip portion N of the pair of restrict elements 60*a*.

An opening of the conveying path 13, i.e., an insert opening of the sheet S, is composed between the end of the abut portion 61 where the restrict member 60 as described above is formed and the apparatus body facing to this end in the present embodiment. The end on the conveying path side of the abut portion 61 is a tapered surface (inclined surface) or a cutaway portion inclined to the conveying path side across the width direction of the insert opening. Thereby, the insert opening of the sheet S is formed such that a gap becomes narrow to the inside of the conveying path (to the downstream in the sheet conveying direction). The restrict members 60 are disposed respectively at the tapered portions provided at the insert opening of the sheet S.

Figure 3:
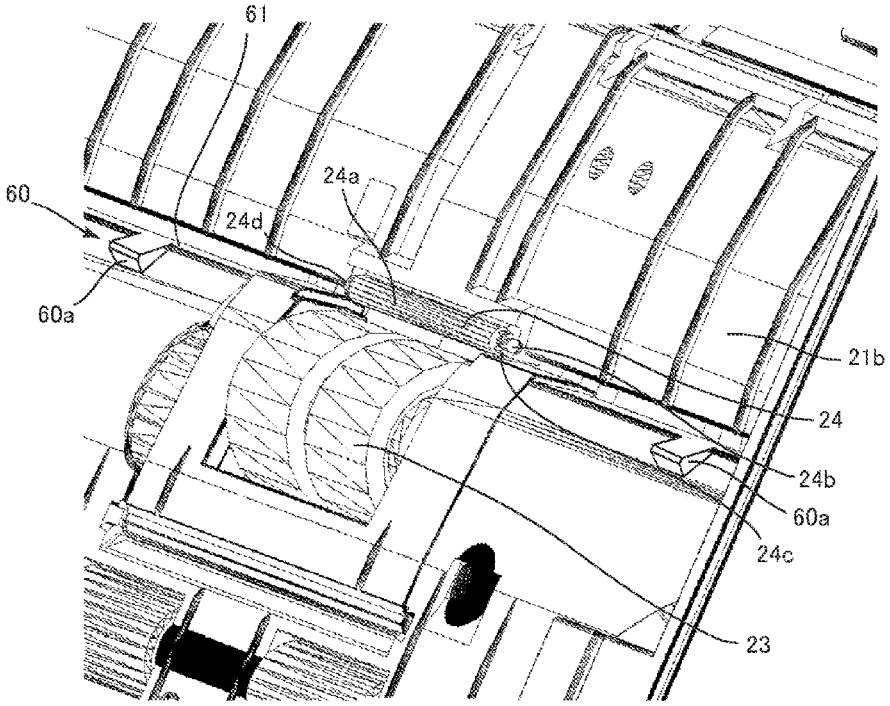
FIG. 3 is an enlarged perspective view of a part of the document information reading apparatus shown in FIG. 2.

The restrict member 60 will be explained more specifically below. The restrict member 60 has the pair of restrict elements 60*a* provided so as to extend the abut portions 61 by keeping a predetermined space in the width direction. The pair of restrict elements 60*a* is disposed on both sides in the width direction of the separation roller 23, respectively, as shown in FIG. 3. These both restrict members 60*a* are disposed equidistantly from the separation roller 23 and are formed such that a surface thereof on the intermediate plate 21*b* side is substantially orthogonal to the upper surface of the intermediate plate 21*b* when the intermediate plate 21*b* is located in the standby position. Such restrict members 60 are also disposed between the intermediate plate 21*b* and the nip portion N.

Then the sheet bundle stacked on the intermediate plate 21*b* in the standby position abuts against the abut portion 61 and the restrict member 60 and is restricted from entering the nip portion N side further. It is noted that the restrict member 60 may be formed integrally with the abut portion 61 or may be fixed with another member. Still further, it is preferable to compose the restrict member 60 by a material that hardly cause abrasion, e.g., a POM material, because the restrict member 60 contacts with the sheet.

The sheet is conveyed such that a center of the sheet is aligned with a center of the tray 21 in the present embodiment. Therefore, the widthwise positions of the pair of restrict elements 60*a* are determined on the basis of the center of the tray 21 so as to be equidistant from the center.

The predetermined space between the pair of restrict elements 60*a* is determined to be what allows a standard ID-1 type card of ISO/IEC 7810 (53.98 mm in length in the sheet conveying direction, 85.60 mm in length in the width direction, and 0.76 mm in thickness) to pass through. That is, the pair of restrict elements 60*a* is formed by separating from each other by 85.60 mm or more in the width direction. Meanwhile, the predetermined space is also determined to be smaller than a width of a sheet whose width is smallest among thin sheets. It is noted that the predetermined space is determined adequately design-wise corresponding to sizes of a card which is thick as compared to a normal sheet such as a plain sheet or of a thin sheet such as a plain sheet to be used. The predetermined space may be made variable by configuring the pair of restrict elements 60*a* to be movable in the width direction.

The gap between the abut portion 61 and the feed roller 22 is determined to be larger than the thickness of a card of 0.76 mm in the present embodiment. This gap is also determined adequately design-wise corresponding to size of a card which is thick as compared to a normal sheet such as a plain sheet.

This arrangement allows a sheet whose width is smaller than the predetermined space to pass through the space between the pair of restrict elements 60*a* and guides to the nip portion N. That is, the card which is thick as described above is conveyed to the nip portion N without touching the pair of restrict elements 60*a*.

Meanwhile, a sheet whose width is larger than the predetermined space is guided to the nip portion in the deflected condition by making the sheet come contact with the pair of restrict elements 60*a*. That is, a sheet such as a plain sheet which is thin and whose width is large is passed on the pair of restrict elements 60*a*. At this time, the sheet is sent to the nip portion N in the deflected condition by coming into contact with the restrict members 60 because the pair of restrict elements 60*a* (restrict members 60) project so as to be overlapped with the feed roller 22. That is, the sheet is conveyed to the nip portion in a condition in which widthwise both ends of the sheet are lifted by the pair of restrict elements 60*a*.

It is noted that a length of the overlapped part in the width direction of the restrict member 60 and the feed roller 22, i.e., an overlap amount, is set to be a degree that allows the sheet to pass through on the restrict members 60 while being deflected. While the sheet is made separable from other sheets by deflecting the sheet as described later, the overlap amount is set to be a degree that assures this separability of the sheet. Meanwhile, there is a possibility that the sheet is jammed if the overlap amount is too large, so that the overlap amount is set to be a degree that causes no jamming.

The apparatus body 11 is made separable to a body portion 11*a* and a cover portion 11*b* bounded by the conveying path 13 through which the sheet is conveyed within the apparatus body 11 in the present embodiment. The body portion 11*a* among them is provided with the tray 21 and the separation roller 23 described above, and the feed roller 22 is supported by the cover portion 11*b*. The cover portion 11*b* is made rotatable with respect to the body portion 11*a* centering on a lower end part of the body portion 11*a*. The conveying path 13 is exposed (opened) by rotating the cover portion 11*b*, so that a sheet jammed within the conveying path 13 can be removed.

In a condition in which the cover portion 11*b* is closed, the feed roller 22 comes into contact with the separation roller 23, and the separation roller 23 recedes in a direction opposite from the bias direction of the spring (moves in a direction separating from the feed roller 22). As a result, the feed roller 22 comes into contact elastically with the separation roller 23.

[Intermediate Plate Moving Apparatus]

Next, the intermediate plate moving apparatus 50, i.e., the moving portion, configured to move the intermediate plate 21*b*, i.e., the sheet receiving member, between the feed position and the standby position will be explained with reference to FIGS. 4 and 5 and by using FIG. 6. The intermediate plate moving apparatus 50 includes the spring 51, i.e., a bias means, a driving gear 52, i.e., driving side member, a rotary shaft 53, i.e., a moved side member, an engagement member fixed to the intermediate plate 21*b*, and one way clutch 55, i.e., a power connecting/disconnecting means.

As shown in FIGS. 4 and 5, the spring 51 is disposed between the intermediate plate 21*b* and a support plate portion 63 of a stationary member 62 and biases in a direction of moving the intermediate plate 21*b* to the feed position. The driving gear 52 is connected with a motor, i.e., a driving means, not shown through an intermediary of a gear train 52*a*. The rotary shaft 53 is disposed in the width direction substantially orthogonal to the sheet conveying direction under the intermediate plate 21*b* (on the support plate portion 63 side) and moves the intermediate plate 21*b* through the engage member 54.

To that end, an engaging projection 53*a* is formed at a front edge of the rotary shaft 53 such that it projects out from an outer circumferential surface of the rotary shaft 53. The engaging projection 53*a* engages with an engaged projection 54*a* projecting in the width direction from the engage member 54 fixed to the intermediate plate 21*b*. Then, the intermediate plate 21*b* is arranged to move to the standby position by the engagement of the engaging projection 53*a* with the engaged projection 54*a* when the rotary shaft 53 rotates in a direction of an arrow B as shown in FIG. 6B.

Figure 6A:
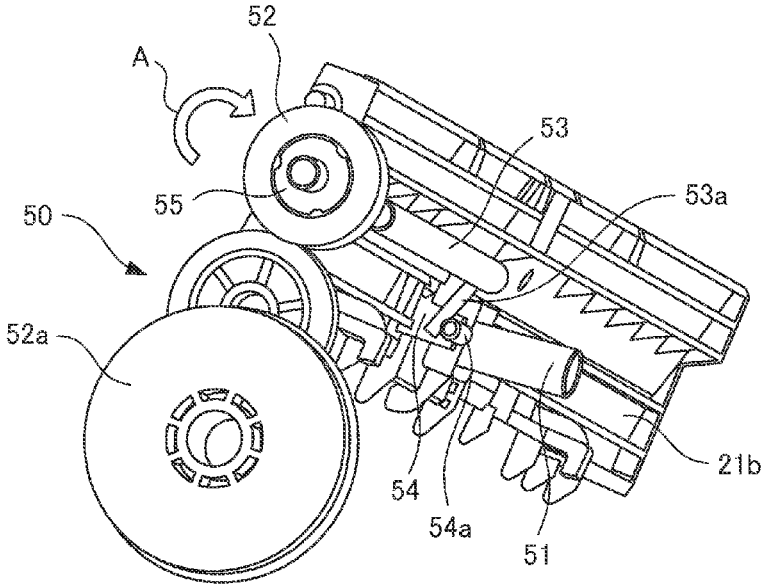

The one way clutch 55 is disposed between the driving gear 52 and the rotary shaft 53 and transmits or disconnects power. That is, when the driving gear 52 rotates in a direction of an arrow A as shown in FIG. 6A, the one way clutch 55 disconnects power between the driving gear 52 and the rotary shaft 53. Meanwhile, when the driving gear 52 rotates in the direction of the arrow B in FIG. 6B, the one way clutch 55 transmits power from the driving gear 52 to the rotary shaft 53.

In the intermediate plate moving apparatus 50 constructed as described above, the driving gear 52 rotates in the direction of the arrow A through the gear train 52*a* as shown in FIG. 6A when the motor drives in a normal direction. In this case, the one way clutch 55 disconnects the power between the driving gear 52 and the rotary shaft 53 as described above. As a result, the intermediate plate 21*b* moves toward the feed position by a bias force of the spring 51. Specifically, the intermediate plate 21*b* rotates in the direction approaching the feed roller 22 centering on the rotation supporting portions.

Figure 6B:
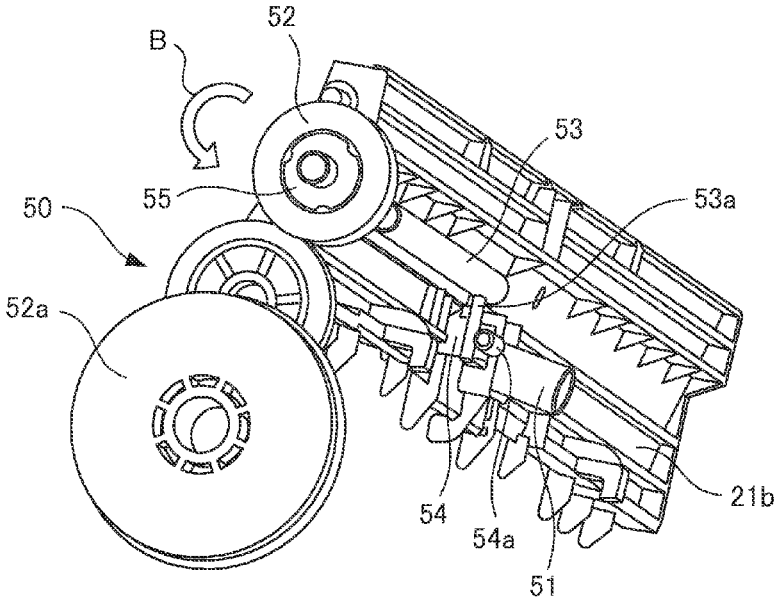

Meanwhile, when the motor rotes in a direction opposite from the normal direction, the driving gear 52 rotates in the direction of the arrow B through the gear train 52*a* as shown in FIG. 6B. In this case, the one way clutch 55 transmits power between the driving gear 52 and the rotary shaft 53 as described above. Then, the rotary shaft 53 also rotates in the same direction with the driving gear 52, and the engaging projection 53*a* of the rotary shaft 53 also rotates in the same direction. The engaging projection 53*a* is engaged with the engaged projection 54*a* of the engage member 54, and the engage member is fixed to the intermediate plate 21*b*. Accordingly, the intermediate plate 21*b* moves toward the standby position by resisting against the bias force of the spring 52 in response to the rotation of the rotary shaft 53 in the direction of the arrow B.

[Information Reading Portion]

As shown in FIG. 1, the information reading portion 3 is disposed in a middle part in the sheet conveying direction of the apparatus body 11 and includes a roller pair 31, a registration sensor 32, image sensors 33*a* and 33*b*. The roller pair 31 is composed of a driving roller 31*a* and a driven roller 31*b*. Among them, the driving roller 31*a* is provided in the body portion 11*a* and the driven roller 31*b* is provided in the cover portion 11*b*, respectively. The driving roller 31*a* is rotationally driven by a motor, i.e., a driving source, not shown and the driven roller 31*b* rotates following to the driving roller 31*a*. The roller pair 31 constructed as described above conveys the sheet conveyed from the sheet feeding portion 2 to the same direction with the conveying direction of the feed roller 22.

The registration sensor 32 detects leading and trailing ends of the sheet conveyed by the roller pair 31. Such a registration sensor 32 may be a photo sensor having light emitting and receiving portions or a sensor that detects motions of a lever for example. The photo sensor detects the sheet passing through the sensor because the sheet blocks light, and the sensor that detects by means of the lever detects the sheet passing through the sensor because the sheet falls down the lever. The photo sensor is adopted in the present embodiment.

Each of the image sensors 33*a* and 33*b* is CIS (close range type image sensor) and reads information on front and back surfaces of the sheet. That is, one image sensor 33*a* is provided on the body portion 11*a* side and the other image sensor 33*b* is provided on the cover portion 11*b* side. The surfaces that read information of the image sensors 33*a* and 33*b* are positioned on the conveying path 13 side to read the information of the both sides of the sheet passing through the conveying path 13 by the image sensors 33*a* and 33*b*. The information read in the present embodiment is information of an image formed on the front surface or the back surface of the sheet.

[Discharge Portion]

Figure 7:
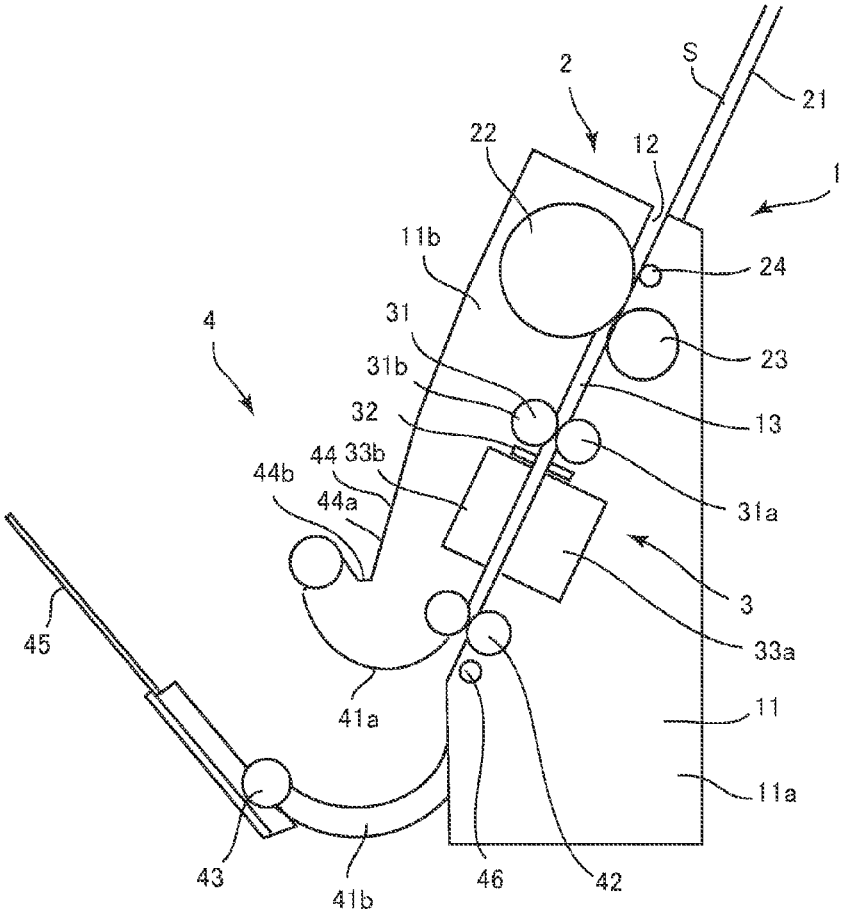
FIG. 7 is a schematic section view of the configuration of the document information reading apparatus shown in FIG. 1, illustrating a different example of a sheet discharge mode of the document information reading apparatus.

The discharge portion 4 includes a U-shaped conveying path 41 disposed downstream in the sheet conveying direction of the apparatus body 11 and continuous with the conveying path 13, a feed roller pair 42, a discharge roller pair 43, a discharge tray 44, and a sheet pressing member 45. Among them, the U-shaped conveying path 41 is a conveying path along which a U-shaped sheet is conveyed. The U-shaped conveying path 41 is composed of a U-shaped curved surface portion 41*a* formed on an under surface of the cover portion 11*b*, and a U-shaped curved member 41*b* connected with the apparatus body 11 by a hinge 46. As shown in FIG. 7, the curved member 41*b* is rotatable centering on the hinge 46. Therefore, when a sheet jams within the U-shaped conveying path 41, it is possible to deal with the jamming by exposing the U-shaped conveying path 41 by rotating the curved member 41*b*.

The feed roller pair 42 is disposed at an entrance entering from the conveying path 13 of the apparatus body 11 to the U-shaped conveying path 41 upstream in the sheet conveying direction of the hinge 46. The feed roller pair 42 is also composed of driving and driven rollers and one roller is provided in the body portion 11*a* and the other roller is provided in the cover portion 11*b*, respectively, in the same manner with the roller pair 31 described above. Then, the feed roller pair 42 conveys the sheet conveyed from the information reading portion 3 to the U-shaped conveying path 41.

The discharge roller pair 43 is provided at an exit of the U-shaped conveying path 41 and discharges the sheet from the U-shaped conveying path 41. The discharge roller pair 43 is also composed of driving and driven rollers and one roller is provided in the cover portion 11*b* and the other roller is provided in the curved member 41*b*, respectively.

The discharge tray 44 is formed on a surface opposite from the body portion 11*a* of the cover portion 11*b* and stacks the sheet discharged out of the discharge roller pair 43. The discharge tray 44 is composed of an inclined surface 44*a* inclined with respect to a horizontal direction and a holding surface 44*b* restricted so as to bend obliquely upward from a lower edge of the inclined surface 44*a*. A front edge of the holding surface 44*b* is located in the vicinity of an exit of the discharge roller pair 43. The sheet discharged out of the discharge roller pair 43 jumps out to the inclined surface 44*a* and is stacked so as to overlap with the inclined surface 44*a* in a condition in which a lower edge of the sheet is supported by the holding surface 44*b*.

The sheet pressing member 45 presses the sheet stacked on the discharge tray 44 such that the sheet does not fall out of the discharge tray 44 due to a disturbance or the like. The sheet pressing member 45 is provided so as to extend from a front end of the curved member 41*b* substantially in a tangential direction of the curved member 41*b*, and faces the inclined surface 44*a* of the discharge tray 44 in a condition in which the curved member 41*b* is closed as shown in FIG. 1. As a result, the sheet discharged out to the discharge tray 44 is nipped between the inclined surface 44*a* and the sheet pressing member 45 and is suppressed from falling out unintentionally.

Figure 8A:
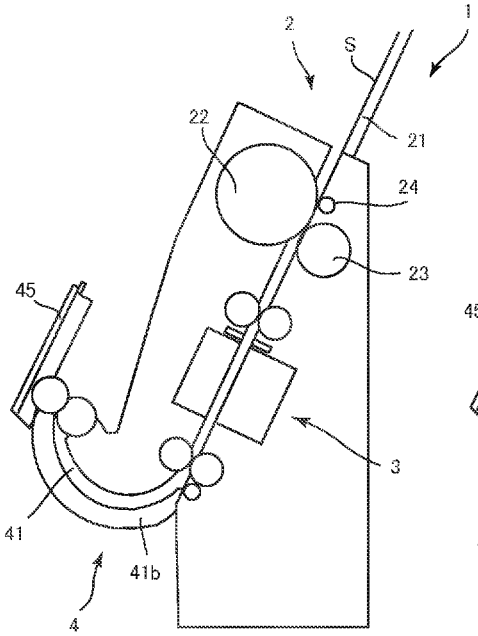
FIGS. 8A and 8B are schematic section views of the configuration of the document information reading apparatus shown in FIG. 1, illustrating operations of a sheet holding member.
Figure 8B:
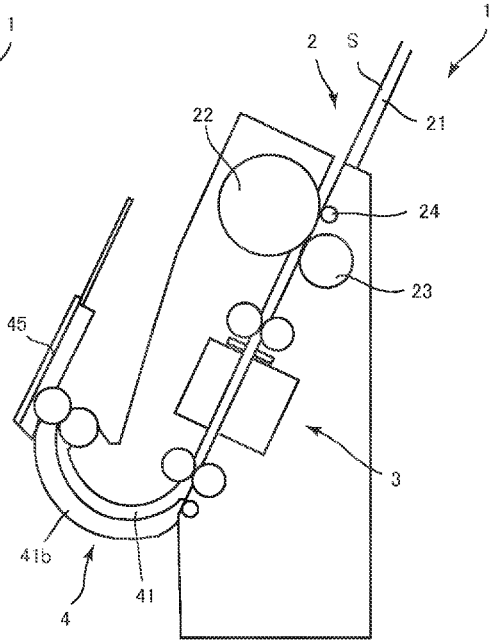

It is noted that the sheet pressing member 45 is constructed to be expandable as shown in FIGS. 8A and 8B in the present embodiment. Therefore, it is possible to adjust a length thereof in accordance to a sheet size by shortening the length as shown in FIG. 8A when a sheet size is small and by prolonging the length as shown in FIG. 8B when a sheet size is large.

It is also possible to discharge the sheet in the condition in which the U-shaped conveying path 41 is exposed by rotating the curved member 41*b* as shown in FIG. 7 in the present embodiment. In this case, the feed roller pair 42 plays the role of the discharge roller pair and the sheet pressing member 45 plays the role of the discharge tray.

Thus, the scanner 1 of the present embodiment allows the sheet discharging method to be changed. For instance, normally the installation space can be compact and be reduced as compared to the condition shown in FIG. 7 by discharging the sheet in the condition as shown in FIG. 1. Meanwhile, the sheet is discharged in the condition shown in FIG. 7 when it is desirable not to pass the sheet through the curved path like the U-shaped conveying path 41.

[Operation of Scanner]

In the embodiment configured as described above, a sheet (or a sheet bundle) from which information is to be read is stacked on the tray 21. At the time when the sheet is stacked on the tray 21, the intermediate plate 21*b* recedes and the leading end of the sheet S enters between the intermediate plate 21*b* and the feed roller 22 and abuts against the abut portion 61 as shown in FIG. 5. Then, when a user presses a read start button provided in the apparatus in this condition for example and an operation starts, the intermediate plate 21*b* is biased by the spring 51 by driven of the intermediate plate moving apparatus 50 and the leading end of the sheet is nipped by the intermediate plate 21*b* and the feed roller 22. At this time, the roller 24 supported at the front end of the intermediate plate 21*b* comes into contact with a back surface of the sheet (undermost sheet in the case of the sheet bundle), and the sheet is nipped by the roller 24 and the feed roller 22.

When the feed roller 22 is rotationally driven from this condition, a large sheet which is larger than the predetermined space between the pair of restrict elements 60*a* is conveyed to the nip portion N in a condition in which the sheet is deflected by overriding its widthwise both ends on the pair of restrict elements 60*a*. Meanwhile, a small sheet smaller than the predetermined space is conveyed to the nip portion N by passing through the space between the pair of restrict elements 60*a*.

While the sheet conveyed to the nip portion N is conveyed to the conveying path 13, the sheet is separated one by one from the sheet bundle in a case of the sheet bundle by rotating the separation roller 23 in the direction opposite from the rotational direction of the feed roller 22. When the sheet is one sheet in contrary, a torque limiter provided in the separation roller 23 is actuated and power to be transmitted to the separation roller 23 is disconnected. Then, the separation roller 23 rotates following the rotation of the feed roller 22. As a result, one sheet is conveyed to the conveying path 13.

The sheet conveyed to the conveying path 13 is nipped by the roller pair 31 to be conveyed further. Then, the registration sensor 32 detects the leading end of the sheet and the image sensors 33*a* and 33*b* read information on the both surfaces (or either surface) of the sheet. That is, the image sensors 33*a* and 33*b* start to read information after a predetermined time since when the registration sensor 32 has detected the leading end of the sheet, and the image sensors 33*a* and 33*b* finish to read information after an elapse of a predetermined time since when the registration sensor 32 has detected a trailing end of the sheet. The information read by the image sensors 33*a* and 33*b* is stored in a storage means (memory) provided in the apparatus or is sent to an external terminal such as a personal computer not shown.

The sheet that has passed through the image sensors 33*a* and 33*b* is then nipped by the feed roller pair 42 and is conveyed to the U-shaped conveying path 41 (in the condition in FIG. 1) or is discharged on the sheet pressing member 45 that functions as a discharge tray (condition in FIG. 7). The sheet conveyed to the U-shaped conveying path 41 is nipped by the discharge roller pair 43 and is discharged further to the discharge tray 44.

The sheet bundle is restricted from entering the nip portion by the abut portion 61 and the restrict member 60 when the intermediate plate 21*b* is in the standby position, so that the part of the sheet bundle hardly enters the nip portion in the overlap condition even if the sheet bundle stacked on the intermediate plate 21*b* is pushed in the present embodiment. Still further, when the sheets whose width is larger than the predetermined space of the pair of restrict elements 60*a*, the sheet can be readily separated from the sheet bundle because the sheet is sent to the nip portion in the deflected condition by being in contact with the pair of restrict elements 60*a*. That is, the sheet is readily separated by deflecting the sheet because a gap is created between coherent sheets. Accordingly, it is possible to suppress a sheet otherwise fed in the layered condition without strictly limiting the gap between the abut portion 61 and the feed roller 22.

Still further, the restrict member 60 is merely projected from the front end of the abut portion 61 and is overlapped in the width direction with the feed roller 22, so that the apparatus is not enlarged and in coupled with the unnecessity of strictly limiting the gap between the abut portion 61 and the feed roller 22, an increase of the cost can be prevented. As a result, the configuration that permits to suppress the sheet otherwise fed in the layered condition at low cost without enlarging the apparatus.

The present embodiment also permits to deal with the conveyance of a sheet such as a plain sheet which is thin and whose width is large and the conveyance of a sheet such as a plastic card which is less deflectable as compared to the plain sheet, is thick and whose width is small, respectively. That is, the sheet which is thick but whose width is small is conveyed by passing between the pair of restrict elements 60*a*. Meanwhile, the sheet which is thin but whose width is large is conveyed in contact with the pair of restrict elements 60*a* in the deflected condition to suppress the sheet otherwise fed in the layered condition as described above. As a result, it is possible to suppress the thin sheet otherwise fed in the layered condition while dealing with the both conveyances of the thick and thin sheets.

Second Embodiment

Figure 9:
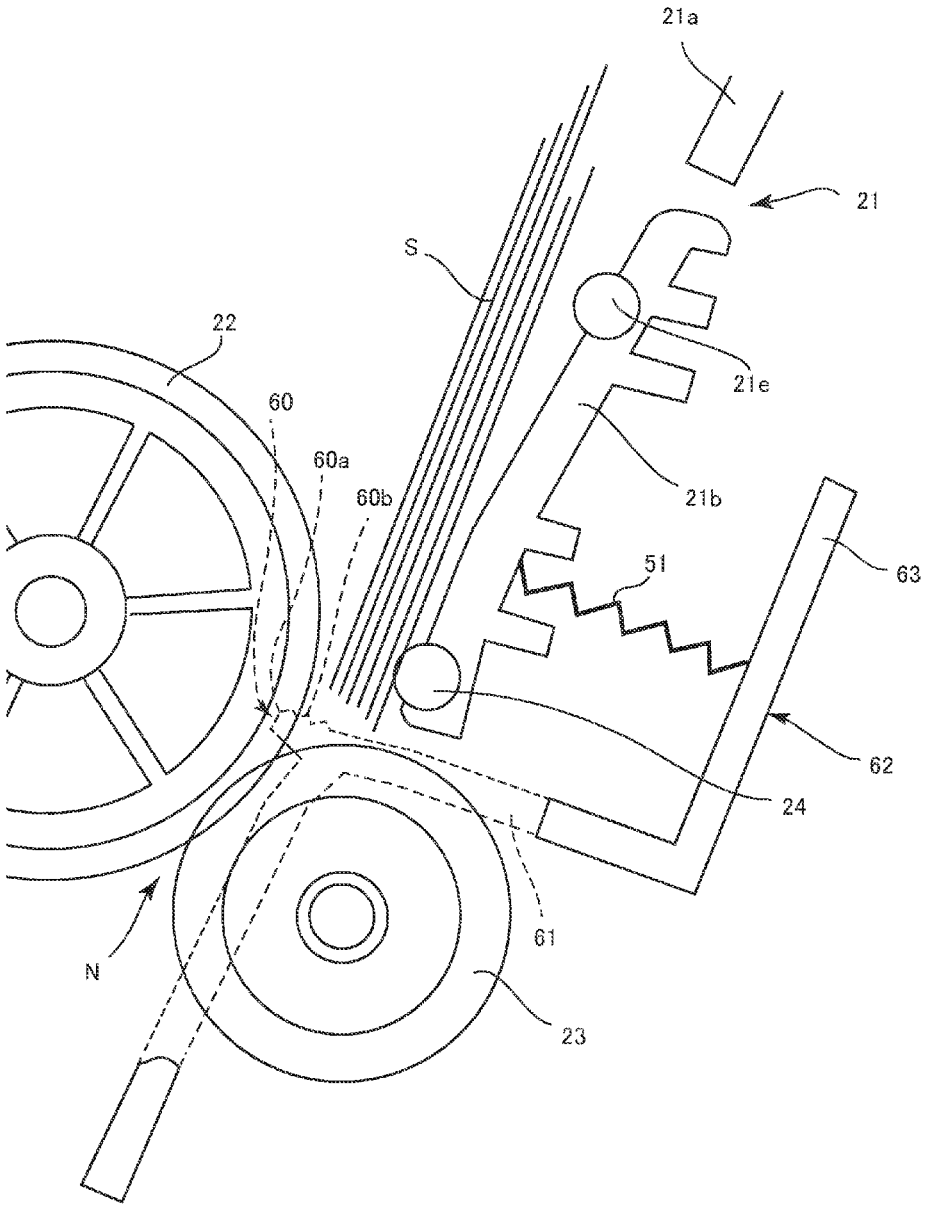
FIG. 9 is an enlarged view partially corresponding to FIG. 5 and showing a second embodiment of the invention.

A second embodiment of the invention will be explained with reference to FIG. 9. In the present embodiment, a surface of the restrict member 60 against which the sheet stacked on the intermediate plate 21*b* abuts (the surface that guides the sheet or the surface on the side of the intermediate plate 21*b*) is formed to be a corrugated surface 60*b*. The corrugated surface 60*b* has a plurality of concave and convex portions formed along the width direction. This arrangement makes the sheet hard to enter the nip portion N between the feed roller 22 and the separation roller 23 even if the leading end of the sheet is curled.

That is, the sheet is stacked on the tray 21 in the condition in which the intermediate plate 21*b* is moved to the standby position and the leading end of the sheet is abutted against the abut portion 61. At this time, however, there is a case when the leading end of the sheet enters the nip portion N after abutting against the abut portion 61 and the restrict member 60 if the leading end of the sheet is curled. Then, the surface of the restrict member 60 against which the sheet abuts is formed to be the corrugated surface 60*b* to catch the leading end of the curled sheet by the corrugated surface so that the leading end of the sheet hardly enters the nip portion N in the present embodiment. The other configuration and effects of the present embodiment are the same with the first embodiment described above.

Third Embodiment

Figure 10:
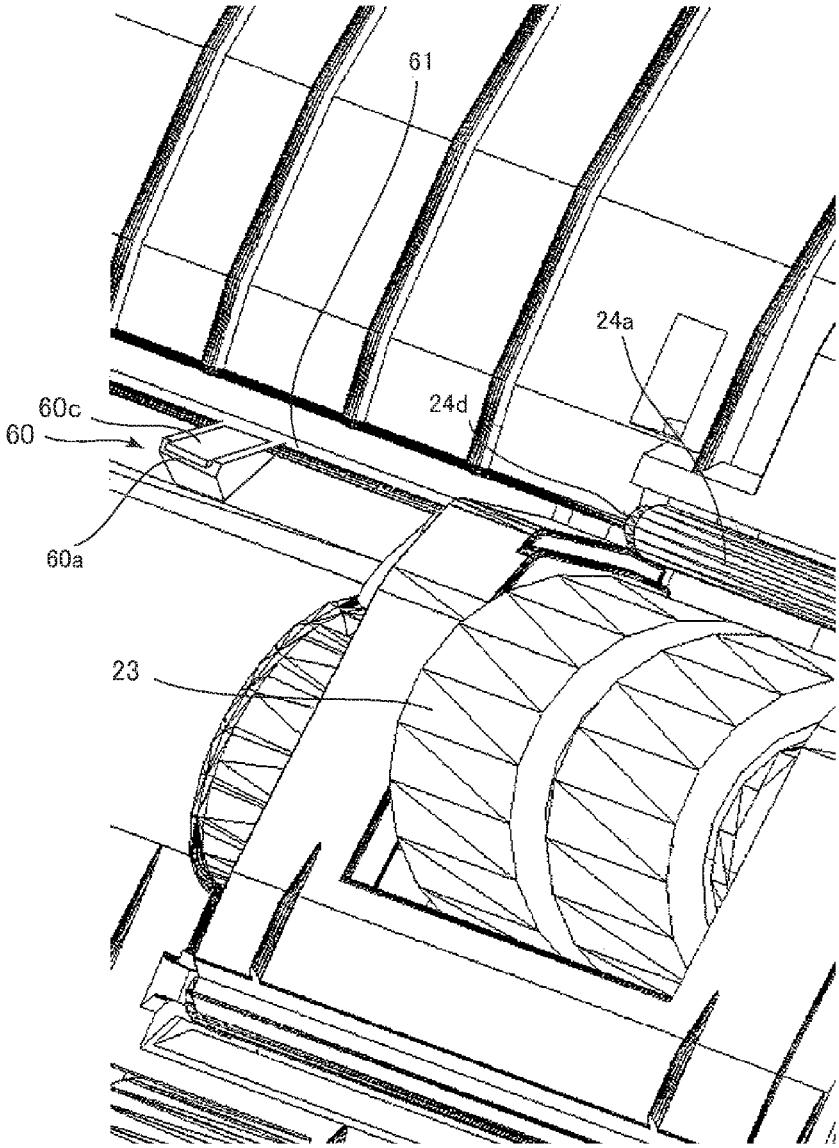
FIG. 10 is an enlarged view partially corresponding to FIG. 3 and showing a third embodiment of the invention.
Figure 11:
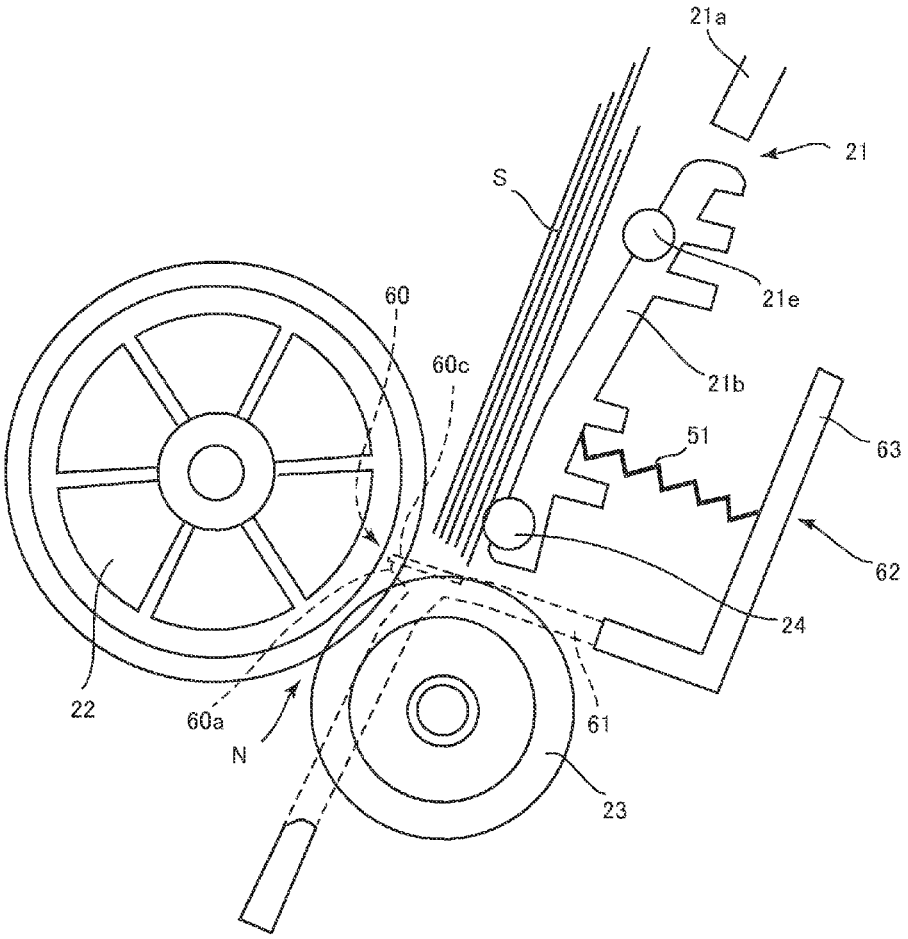
FIG. 11 is an enlarged view also partially corresponding to FIG. 5.

A third embodiment of the invention will be explained with reference to FIGS. 10 and 11. In the present embodiment, the restrict member 60 is provided with a rubber member 60*c* on the surface against which the sheet stacked on the intermediate plate 21*b* abuts (the surface that guides the sheet, the surface on the side of the intermediate plate 21*b*) so that a front end thereof projects out of the restrict member 60. Specifically, the rubber member 60*c* is formed like a sheet and is pasted on the surface of the restrict member 60 against which the sheet abuts. The leading end of the sheet-like rubber member 60*c* is formed to project out of the restrict member 60.

This arrangement allows the sheet to be readily separated by the rubber member 60*c* that projects out of the front end of the restrict member 60 even if a plurality of sheets tries to override the restrict member 60. That is, because resistance between the rubber member 60*c* and the sheets is large, the sheets in contact with the rubber member 60*c* are remained and are separated readily from the sheet to be conveyed among the plurality of sheets that tries to override the restrict member 60. Accordingly, it is possible to prevent the sheet otherwise from being fed in the layered condition more reliably.

This arrangement also makes it possible such that the leading end of the sheet hardly enters the nip portion even if the leading end of the sheet is curled in the same manner with the second embodiment. That is, it is possible to arrange such that the leading end of the curled sheet hardly overrides the restrict member 60 by a friction force with the restrict member 60 as the leading end comes into contact with the rubber member 60*c*. The other configuration and effects of the present embodiment are the same with the first embodiment described above.

Fourth Embodiment

Figure 12:
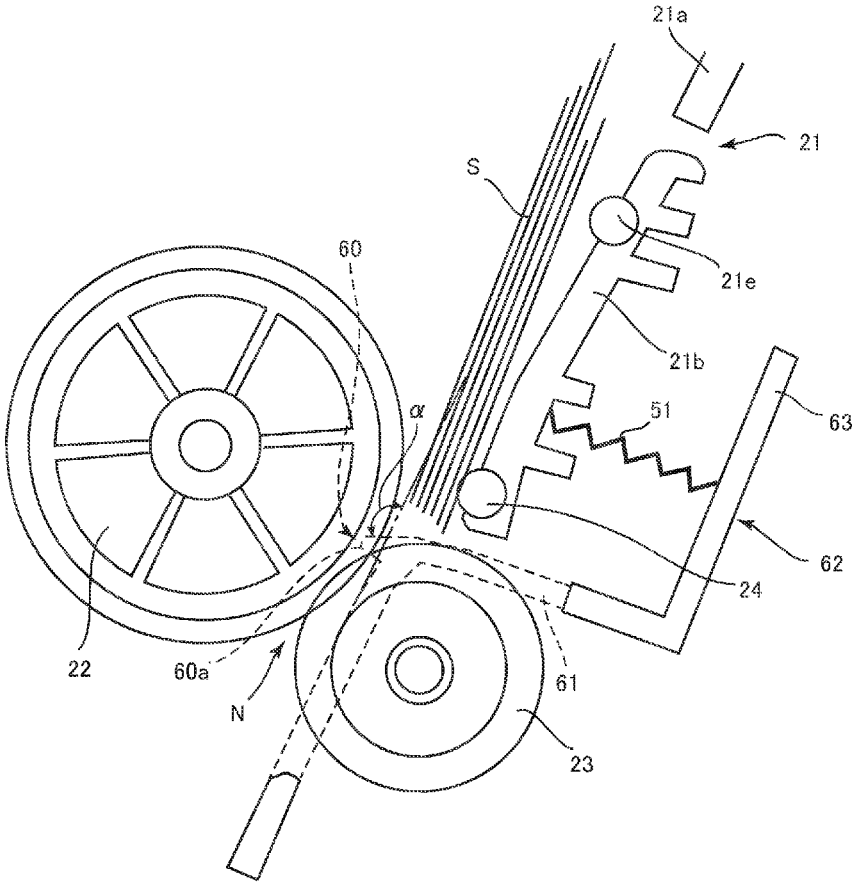
FIG. 12 is an enlarged view partially corresponding to FIG. 5 and showing a fourth embodiment of the invention.
Figure 13:
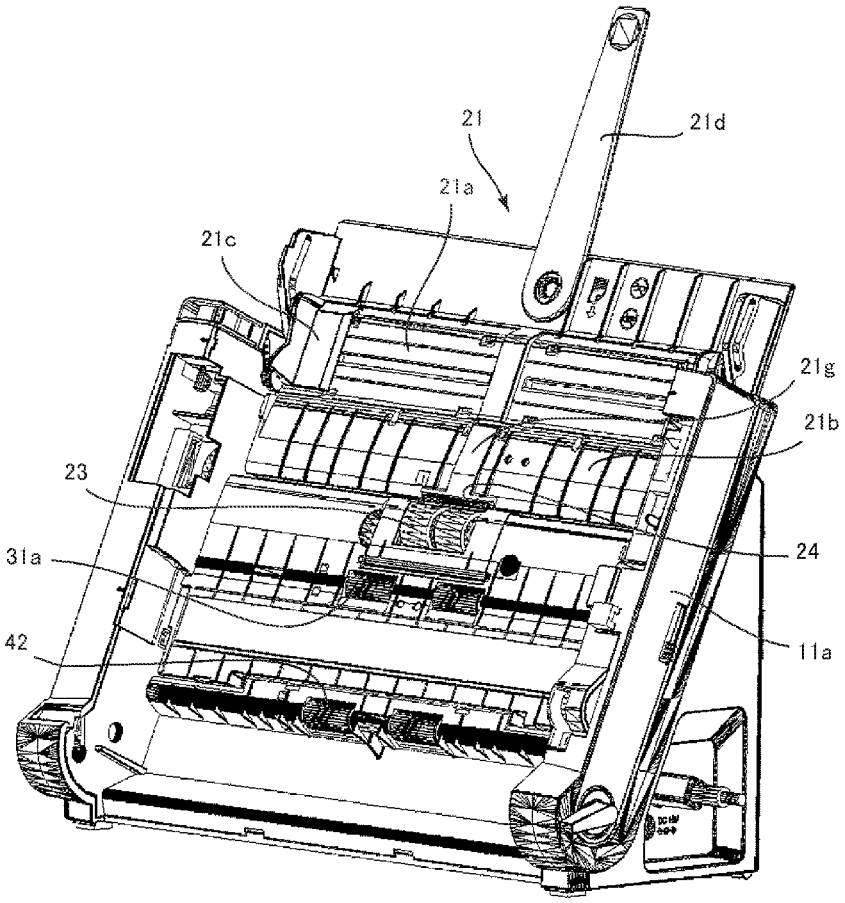
FIG. 13 is a perspective view showing a condition in which a cover portion of the document information reading apparatus including a sheet conveying apparatus of the fifth embodiment of the invention is removed.

A fourth embodiment of the invention will be explained with reference to FIG. 12. In the present embodiment, the restrict member 60 is formed such that an angle α formed between the surface against which the sheet stacked on the intermediate plate 21*b* abuts (the surface that guides the sheet, the surface on the side of the intermediate plate 21*b*) and the sheet conveying direction (a chain line in FIG. 12) becomes an obtuse angle. In other words, the closer to the feed roller 22, the more the restrict member 60 is inclined in a direction toward the downstream in the sheet conveying direction (of the feed roller 22). Therefore, the surface of the restrict member 60 against which the sheet abuts is also inclined with respect to the abut portion 61.

This arrangement allows resistance of the sheet to be conveyed by overriding the restrict member 60 to be reduced. That is, the arrangement enables the sheet to easily override the restrict member 60. As a result, it is possible to suppress a case in which a sheet is unable to override the restrict portion and is not conveyed. The other configuration and effects of the present embodiment are the same with the first embodiment described above.

It is noted that the respective embodiments described above may be carried out by adequately combining them. Still further, the pair of restrict elements 60*a* may not be overlapped in the width direction with the feed roller 22 if it is possible to suppress a thin sheet otherwise fed in the layered condition. For instance, it is possible to suppress the thin sheet fed in the layered condition by adequately restricting the gap between the pair of restrict elements 60*a* and the feed roller 22, even though the cost increases. The thick sheet is passed through the space between the pair of restrict elements 60*a* in the same manner with the respective embodiments described above.

The feed rotator and the separation member that convey the sheet are not limited to be the feed roller and the separation roller, and may be composed of other components such as a conveyor belt and a separation belt. The separation member is not also limited to be a rotator and may be a separation sheet or the like. The low friction member is not also required to be disposed at the leading end of the sheet receiving member and may be disposed at other parts such as a middle portion of the sheet receiving member, as long as the low friction member faces the feed rotator and can nip the sheet with the feed rotator.

Fifth Embodiment

A fifth embodiment of the invention will be explained with reference to FIGS. 13 through 17. It is inevitable to produce a gap between an intermediate plate and a separation roller in a configuration in which the separation roller is provided downstream in the sheet conveying direction of the intermediate plate as described in Patent Literature 1 described above. The gap increases especially in the configuration in which the intermediate plate rocks in directions close to and distant from a feed roller. Therefore, when a sheet is moved in a direction opposite from the sheet conveying direction by the separation roller to separate the sheet from a sheet bundle, there is a possibility that a part of the sheets enters the abovementioned gap. There is also a possibility that a leading end portion of the sheet stacked on the intermediate plate enters the gap. If the part (including the leading end) of the sheet enters the gap, the sheet may be clogged, causing jamming, or may generate a skew by which the sheet is conveyed askew.

When a thin sheet having small strength is to be conveyed in particular, the sheet tends to deflect and a part of the sheet tends to enter the abovementioned gap when the sheet is moved by the separation roller in the direction opposite from the sheet conveying direction. There has been known since the past a configuration in which a sheet is conveyed by making a sheet conveying angle get closer to the vertical direction in order to minimize an installation area of the apparatus. Although own weight acts on the stacked sheet in a direction getting closer to the separation roller, the sheet is moved by the separation roller in a direction opposite from the direction of own weight in the case of this configuration. Due to that, the sheet tends to deflect more and the part of the sheet tends to enter the gap as described above.

It is noted that a guide member is provided additionally between the intermediate plate and the separation roller to guide a leading end of a sheet to a nip portion of the separation roller and a feed roller in the configuration described in Patent Literature 1 described above. Although the gap between the intermediate plate and the separation roller can be reduced in such configuration, it is inevitable to produce a gap between the guide member and the intermediate plate and there is a possibility that a part of the sheet enters the gap.

In view of the circumstance described above, the present embodiment aims at realizing a configuration that can prevent the sheet from entering the gap between the sheet receiving member and the separation rotator. The configuration will be described specifically below. It is noted that the parts the present embodiment overlapping with those of the first through fourth embodiments described above will be denoted by the same reference numerals and an explanation thereof will be basically omitted below. The following explanation will be made centering on parts different from those embodiments and on required parts among the overlapped parts.

The separation roller 23 is provided downstream in the sheet conveying direction of the feed roller 22 of the tray 21 at the position facing the feed roller 22 also in the present embodiment. The separation roller 23 is disposed at a position adjacent to the roller 24 in the sheet conveying direction determined by the feed roller 22 such that the separation roller 23 nips a sheet with the feed roller 22. The separation roller 23 is also disposed such that a gap G is interposed between the intermediate plate 21*b* of the tray 21 and the separation roller 23 as shown in FIGS. 14 through 17. That is, the gap G in the sheet conveying direction is provided such that the front end of the intermediate plate 21*b* does not come into contact with the separation roller 23 regardless of rotational position of the intermediate plate 21*b*.

Figure 14:
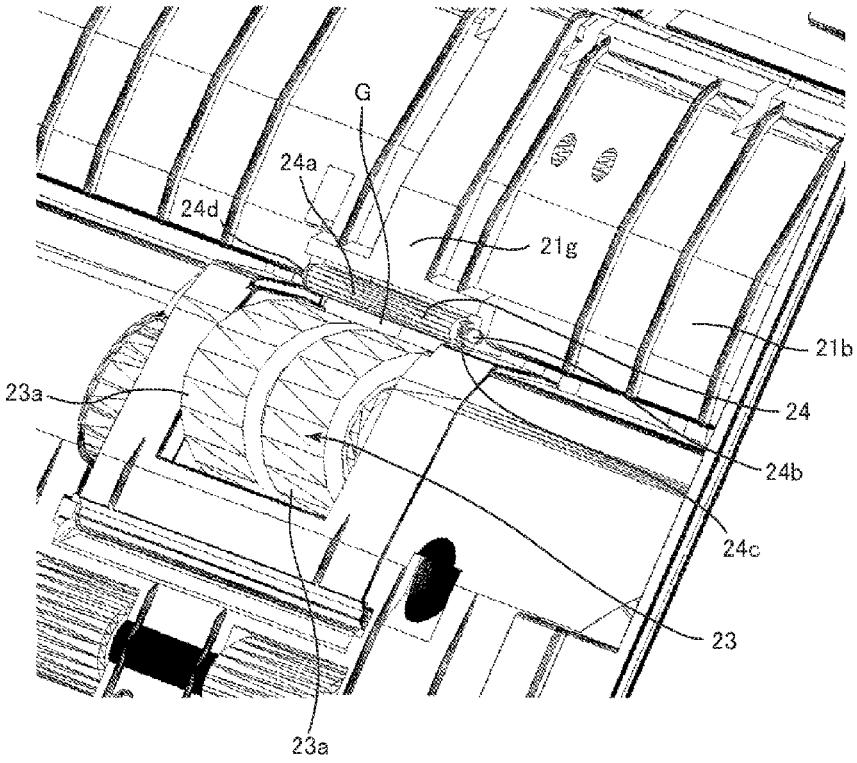
FIG. 14 is an enlarged perspective view of a part of the document information reading apparatus shown in FIG. 13.
Figure 15:
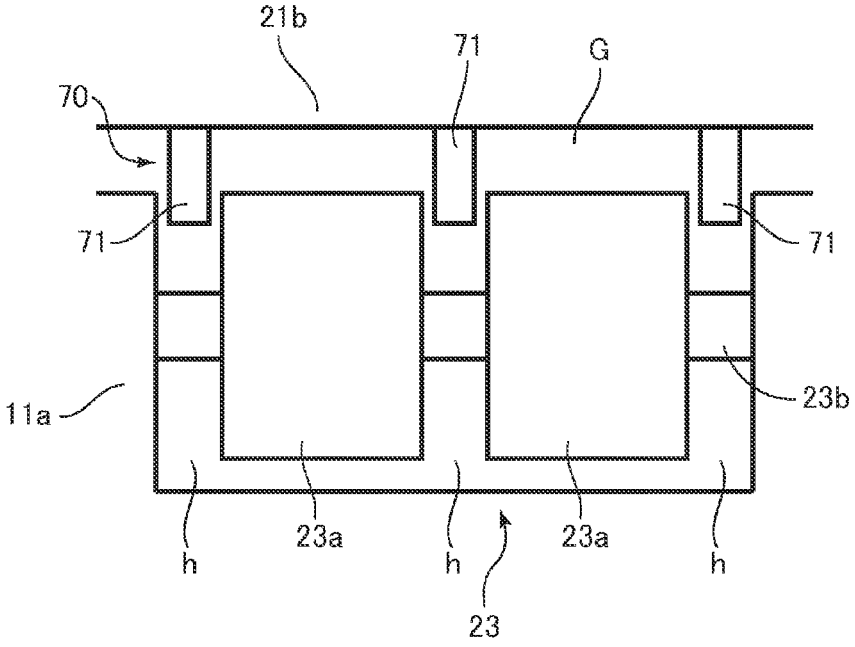
FIG. 15 is an enlarged schematic plan view of the intermediate plate and a separation roller.

In the present embodiment, the separation roller 23 is composed of a plurality of separation elements, i.e., roller elements 23*a*, as shown in FIGS. 14 and 15. In the case shown in the figures, the two roller elements 23*a* are combined as the separation roller 23. Specifically, the two cylindrical roller elements 23*a* are disposed side by side along a rotational shaft 23*b* such that the two roller elements 23*a* rotate together with the rotational shaft 23*b* centering on the rotational shaft 23*b*. Predetermined spaces (h) are also provided in the width direction respectively between the roller elements 23*a* and between the roller elements 23*a* (the separation roller 23) and the body portion 11*a*.

The separation roller 23 constructed as described above is supported movably (rockably) in the direction approaching to/separating from the feed roller 22, and is biased in the direction to the feed roller 22 by a spring not shown. That is, the rotational shaft 23*b* is supported at a predetermined position of the body portion 11*a* movably in the direction approaching to/separating from the feed roller 22, and is biased in the direction to the feed roller 22 by the spring.

The separation roller 23 is rotationally driven by the motor M (see FIG. 1), i.e., a driving source, also in the direction opposite from the rotational direction (sheet conveying direction) of the feed roller 22. That is, the rotational drive of the motor M is transmitted to the rotational shaft 23*b* by a power transmission mechanism such as gears and the separation roller 23 rotates together with the rotational shaft 23*b*. The separation roller 23 makes it possible to easily separate a sheet to be conveyed from other sheets by generating a sheet resistance that acts in the direction opposite from the sheet conveying direction by rotating in the direction opposite from the rotational direction of the feed roller 22 in conveying the sheet by the feed roller 22. It is noted that the separation roller 23 is provided with a torque limiter so that transmission of power from the motor can be cut off when an excessive torque is applied to the separation roller 23.

The apparatus body 11 is made separable to the body portion 11*a* and the cover portion 11*b* bounded by the conveying path 13 through which the sheet is conveyed within the apparatus body 11 also in the present embodiment. The body portion 11*a* among them is provided with the tray 21 and the separation roller 23 described above, and the feed roller 22 is supported by the cover portion 11*b*. The cover portion 11*b* is made rotatable with respect to the body portion 11*a* centering on the lower end part of the body portion 11*a*. The conveying path 13 is exposed (opened) by rotating the cover portion 11*b*, so that a sheet jammed within the conveying path 13 can be removed.

In the condition in which the cover portion 11*b* is closed, the feed roller 22 comes into contact with the separation roller 23, and the separation roller 23 recedes in the direction opposite from the bias direction of the spring (moves in the direction separating from the feed roller 22). As a result, the feed roller 22 comes into contact elastically with the separation roller 23. It is noted that the feed roller 22 comes also into contact with the roller 24 provided at the front end portion of the intermediate plate 21*b* and described later.

Figure 17:
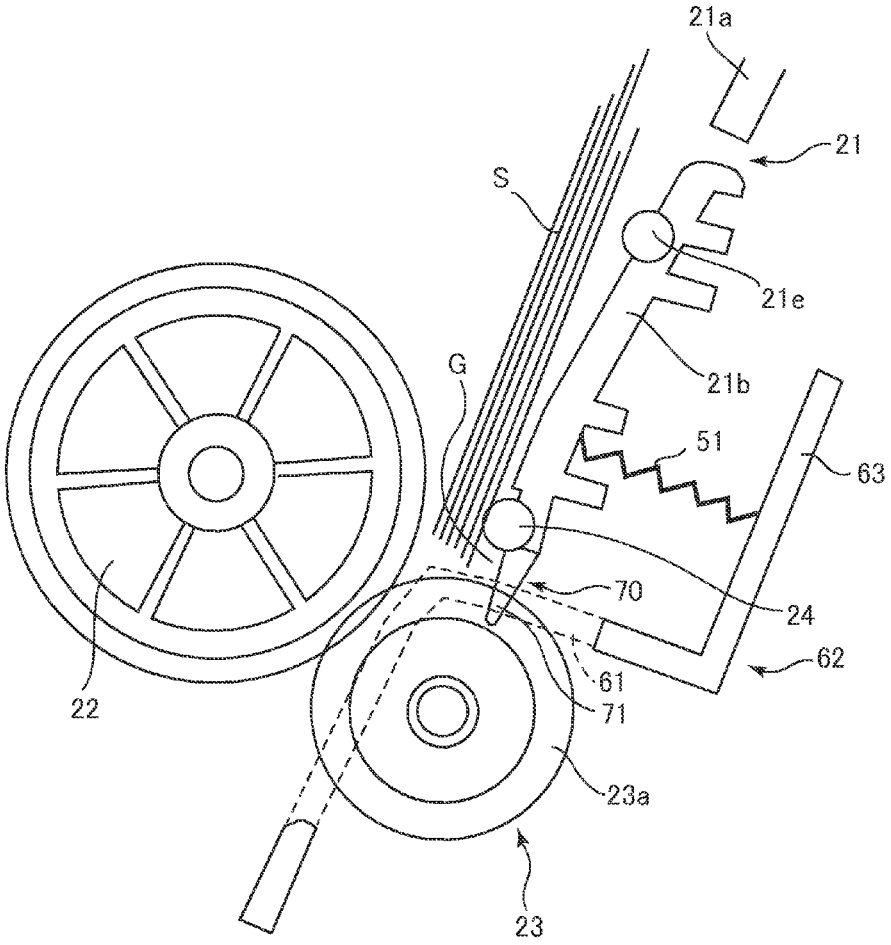
FIG. 17 is a schematic enlarged section view, similar to FIG. 16, showing a condition in which sheets are mounted on a tray.

The intermediate plate 21*b* also rotates centering on the rotation support portion in the direction of resisting against the resilient force of the spring 51 by a driving force transmitted from the motor, i.e., the driving source not shown, through the power transmission mechanism such as the gears. Then, the gap between the feed roller 22 and the intermediate plate 21*b* is provided as shown in FIG. 17.

That is, if the intermediate plate 21*b* is kept in a condition in which the intermediate plate 21*b* is biased toward the feed roller 22, a leading end of a sheet (or a sheet bundle) S hardly enters between the intermediate plate 21*b* and the feed roller 22 in stacking the sheet on the tray 21. Accordingly, a gap is made between the intermediate plate 21*b* and the feed roller 22 by arranging such that the intermediate plate 21*b* rotates in the direction opposite from the bias direction of the spring 51 also in the present embodiment. This arrangement allows the leading end of the sheet (or the sheet bundle) S to be readily entered between the intermediate plate 21*b* and the feed roller 22 in stacking the sheet on the tray 21 and the sheet to be smoothly conveyed by the feed roller 22.

In the present embodiment, the intermediate plate 21*b* is provided with a project member 70 from the front end thereof along the sheet conveying direction of the feed roller 22. That is, the project member 70 is a restrict portion, and projects to a position where the project member 70 is overlapped in the width direction orthogonal to the sheet conveying direction with the separation roller 23, at least one member among the feed rotator and the separation member, by passing through the gap G described above from the downstream end in the sheet conveying direction of the intermediate plate 21*b* and where the project member 70 is offset in the width direction from the separation roller 23. In other words, the project member 70 is overlapped with the separation roller 23. The project member 70 disposed as described above restricts a leading end position of the sheet stacked on the intermediate plate 21*b*.

The project member 70 will be explained more specifically below. The project member 70 is composed of a plurality (three in the case of FIG. 15) of projection elements 71 as shown in FIG. 15. These project elements 71 are formed so as to project from the downstream end in the sheet conveying direction of the intermediate plate 21*b* to a gap between the widthwise end surfaces of the plurality of roller elements 23*a* composing the separation roller 23 and to positions adjacent to the widthwise both ends of the separation roller 23. The respective project elements 71 may be provided integrally with the intermediate plate 21*b* or may be constructed by fixing different members. It is noted that the plurality of project elements 71 composing the project member 70 is disposed along the width direction (longitudinal direction) of the intermediate plate 21*b*. That is, the plurality of project elements 71 is provided side by side in order to fill in the width direction not only the parts corresponding to the gaps of the rollers but also, although not shown, gaps between the intermediate plate 21*b* and the apparatus body facing the end portion of the intermediate plate 21*b*. Accordingly, the apparatus body is provided with insertion grooves into which the project elements 71 are inserted respectively in response to the project elements 71.

The gaps (h) exist respectively in the width direction between the two roller elements 23*a* and between the roller elements 23*a* and the body portion 11*a* as described above. Accordingly, the respective project elements 71 are disposed so as to enter the gaps (h). Therefore, a width of each project element 71 is made smaller than the gap (h). A surface on the feed roller 22 side of each project element 71 is located at a position distant from the feed roller 22 more than the surface (sheet stacking surface) on the feed roller 22 side of the intermediate plate 21*b*. Then, it is so arranged that each project element 71 is not brought into contact with the feed roller 22 even if the intermediate plate 21*b* approaches the feed roller 22 most.

However, it is also possible to arrange such that the surface of each project element 71 and the sheet stacking surface of the intermediate plate 21*b* are leveled in connection with a length and others of each project element 71 described below so long as each project element 71 does not come into contact with the feed roller 22 regardless of the position of the intermediate plate 21*b*. Similarly to that, it is also possible to position the surface of each project element 71 on the side of the feed roller 22 more than the sheet stacking surface of the intermediate plate 21*b*.

Figure 16:
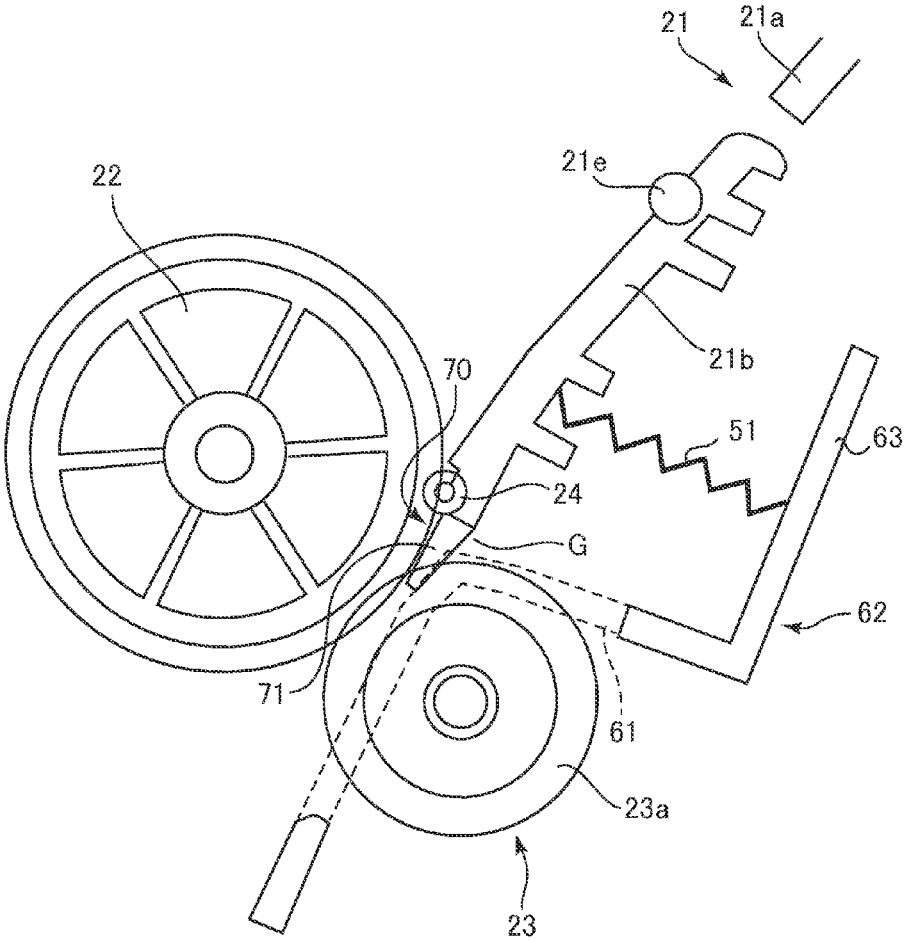
FIG. 16 is an enlarged schematic perspective view of the corresponding part of the document information reading apparatus shown in FIG. 1.

The length of each project element 71 (projection length from the front end of the intermediate plate 21*b*) is arranged to be longer than a length in the sheet conveying direction of the gap G. However, the shape of each project element 71 including the length and the surface position is arranged such that the project element 71 does not come into contact with the feed roller 22 regardless of the moves of the intermediate plate 21*b* that approaches to/separates from the feed roller 22. That is, the length, the surface position and the shape of each project element 71 are restricted such that each project element 71 does not come into contact with the feed roller 22 at the position where the roller 24 of the intermediate plate 21*b* comes into contact with the feed roller 22, i.e., the position where the intermediate plate 21*b* approaches the feed roller 22 most, as shown in FIG. 16. It is noted that even when the intermediate plate 21*b* separates from the feed roller 22 and the front end of the intermediate plate 21*b* approaches the rotational shaft 23*b* of the separation roller 23 most as shown in FIG. 17, each project element 71 will not come into contact with the rotational shaft 23*b* because a diameter of the rotational shaft 23*b* is small.

The project member 70 of the present embodiment is constructed as described above so that the project member 70 crosses over the gap G between the intermediate plate 21*b* and the separation roller 23 regardless of the position of the intermediate plate 21*b*. In connection with that, the project member 70 is prevented from coming into contact with the feed roller 22 and the separation roller 23 regardless of the position of the intermediate plate 21*b*. It is noted that although each project element 71 shown in the figures is tapered to be the closer to the front end, the thinner the thickness, the project element 71 may be formed into other shapes so long as the abovementioned relationship is fulfilled. For instance, each project element 71 may be formed into a plate-like shape or a bar-like shape.

[Operation of Scanner]

In the present embodiment configured as described above, a sheet (or a sheet bundle) from which information is to be read is stacked on the tray 21. At the time when the sheet is stacked on the tray 21, the intermediate plate 21*b* recedes and the leading end of the sheet S enters between the intermediate plate 21*b* and the feed roller 22 as shown in FIG. 17. Then, when a user presses a read start button provided in the apparatus in this condition for example and an operation starts, the intermediate plate 21*b* is biased by the spring 51 and the leading end of the sheet is nipped by the intermediate plate 21*b* and the feed roller 22. At this time, the roller 24 supported at the front end of the intermediate plate 21*b* comes into contact with a back surface of the sheet (undermost sheet in the case of the sheet bundle), and the sheet is nipped by the roller 24 and the feed roller 22.

The feed roller 22 is rotationally driven from this condition, and the separation roller 23 rotates in the opposite direction. Thereby, the sheet is separated one by one from the sheet bundle in the case of the sheet bundle and is conveyed to the conveying path 13. When the sheet is one sheet in contrary, a torque limiter provided in the separation roller 23 is actuated and power to be transmitted to the separation roller 23 is disconnected. Then, the separation roller 23 rotates following the rotation of the feed roller 22. As a result, one sheet is conveyed to the conveying path 13.

The sheet conveyed to the conveying path 13 is nipped by the roller pair 31 to be conveyed further. Then, the registration sensor 32 detects the leading end of the sheet and the image sensors 33*a* and 33*b* read information on the both surfaces (or either surface) of the sheet. That is, the image sensors 33*a* and 33*b* start to read information after a predetermined time since when the registration sensor 32 has detected the leading end of the sheet, and the image sensors 33*a* and 33*b* finish to read information after an elapse of a predetermined time since when the registration sensor 32 has detected a trailing end of the sheet. The information read by the image sensors 33*a* and 33*b* is stored in the storage means (memory) provided in the apparatus or is sent to an external terminal such as a personal computer not shown.

The sheet that has passed through the image sensors 33*a* and 33*b* is then nipped by the feed roller pair 42 and is conveyed to the U-shaped conveying path 41 (in the condition in FIG. 1) or is discharged on the sheet pressing member 45 that functions as a discharge tray (condition shown in FIG. 7). The sheet conveyed to the U-shaped conveying path 41 is nipped by the discharge roller pair 43 and is discharged further to the discharge tray 44.

According to the present embodiment, the project member 70 is formed from the front end of the intermediate plate 21*b* through the gap G to the position where the project member 70 overlaps in the width direction with the separation roller 23 and where the project member 70 is offset in the width direction from the separation roller 23. Accordingly, it is possible to prevent a part of the sheet from entering the gap G. That is, the sheet bundle is returned in the direction opposite from the sheet conveying direction in separating the sheet from the sheet bundle by the separation roller 23. At this time, the part of the sheet is deflected and tends to easily enter the gap G between the separation roller 23 and the intermediate plate 21*b*.

In a case of a thin sheet having small strength in particular, the sheet tends to deflect and a part thereof tends to enter the gap G. In a case when the tray 21 is disposed aslant and own weight of a sheet stacked on the tray 21 acts in a direction in which the sheet approaches to the separation roller 23, the sheet tends to deflect because the sheet is returned against the own weight thereof in returning by the separation roller 23. There is also a case when the leading end of the sheet enters the gap G regardless the return made by the separation roller 23.

The present embodiment is arranged to be able to prevent the part of the sheet from entering the gap G even if the part of the sheet tends to enter the gap G as described above by guiding the part of the sheet by the project member 70. Because the project member 70 is overlapped with the separation roller 23 in the width direction in particular, the project member 70 can be kept crossing over the gap G and can securely prevent the part of the sheet from entering the gap G even when the intermediate plate 21*b* rocks. That is, it is conceivable to reduce the gap G by bringing the front end of the project member closer to the outer circumferential surface of the separation roller 23. However, this configuration has a possibility that size of the gap between the project member and the separation roller 23 varies and a sheet enters this gap when the intermediate plate 21*b* rocks. In contrast, because the project member 70 is overlapped in the width direction with the separation roller 23 in the present embodiment, such a gap is hardly produced or no such gap is produced between the project member 70 and the separation roller 23 regardless of the rock motion of the intermediate plate 21*b*. As a result, it is possible to securely prevent the part of the sheet from entering the gap G.

With the arrangement described above, the present embodiment enables to prevent the sheet from entering the gap G, to reduce cases when a sheet is jammed or skewed, and to convey the sheet stably. It is also possible to prevent the project element 71 from coming into contact with the separation roller 23 regardless of the rock motion of the intermediate plate 21*b* with the simple configuration by disposing the project element 71 of the project member 70 between the roller elements 23*a* and between the roller elements 23*a* and the body portion 11*a*. Accordingly, it is also possible to reduce the manufacturing cost.

It is noted that the roller 24 is disposed at the front end of the intermediate plate 21*b* to reduce a resistance to the return of the sheet made by the separation roller 23 in the present embodiment. Accordingly, it is possible to suppress the sheet from deflecting in returning the sheet by the separation roller 23. As a result, in combination with the existence of the project member 70 described above, it is possible to convey the sheet stably while preventing the sheet from entering the gap G more reliably.

If the roller 24 is omitted in the configuration described above, the leading end of the sheet is guided by the project member 70 and tends to readily come into contact with the feed roller 22. Therefore, it is possible to downsize the apparatus by downsizing the feed roller 22. That is, the leading end of the sheet is hard to come into contact with the feed roller 22 if the feed roller 22 is downsized without providing the project member 70 of the present embodiment. In contrast, it is possible to guide the leading end of the sheet by the project member 70 and to bring the leading end closer to the feed roller 22 even if the feed roller 22 is downsized in the present embodiment. As a result, the apparatus can be downsized because the sheet can be securely conveyed even if the feed roller 22 is downsized.

Figure 18:
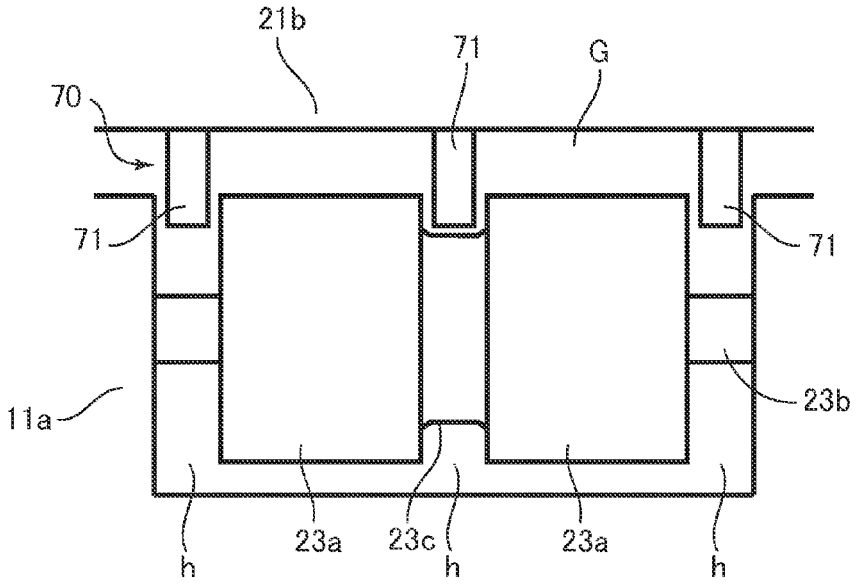
FIG. 18 is an enlarged schematic plan view, similar to FIG. 15, showing another example of the separation roller.

It is noted that the case of using the configuration in which the separation roller 23 is composed of the plurality of roller elements 23*a* has been explained in the fifth embodiment described above. However, the configuration of the separation roller 23 is not limited to that. For instance, the separation roller 23 may be what a concave portion 23*c* is formed at a center part of the separation roller 23 as shown in FIG. 18. In this case, the center project element 71 is disposed such that the project element 71 enters the concave portion 23*c*. The length and others of the center project element 71 are restricted so that the project element 71 does not come into contact with the concave portion 23*c* regardless of positions of the intermediate plate 21*b*.

The separation roller may be also composed of three or more roller elements, may be provided with two or more concave portions, or may be composed of these in combination. The project elements may be provided corresponding to a number of the gaps between the roller elements or to a number of concave portions. Meanwhile, the separation roller may be also composed of one roller element without providing any concave portion. In this case, project elements are provided at both adjacent sides in the width direction of the separation roller. The number of the project elements may not be a plural number, so long as at least one project element is formed so as to cross over the gap between the intermediate plate and the separation roller. However, it is preferable to provide a plurality of project elements to more securely prevent the part of the sheet from entering the gap.

Figure 19:
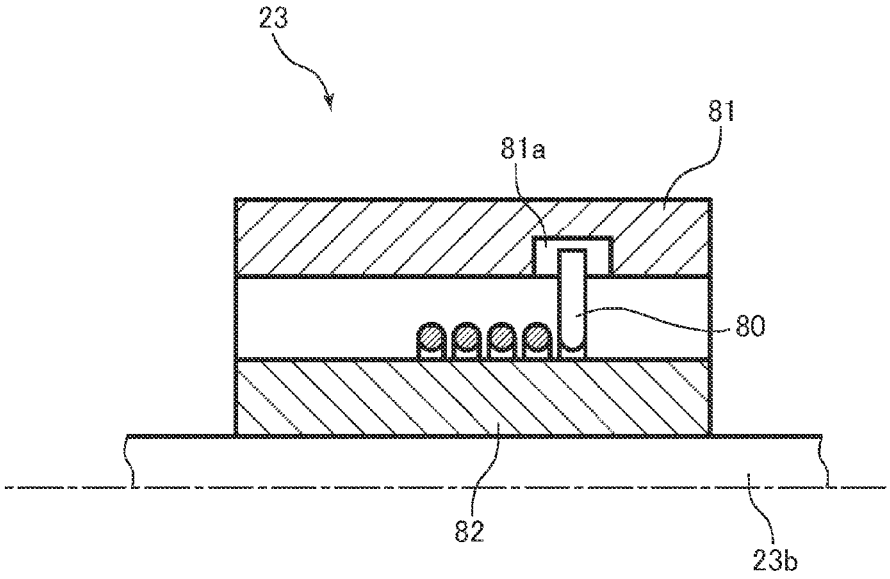
FIG. 19 is a schematic section view of a half of a configuration of another example of the configuration driving the separation roller.

Still further, although the separation roller 23 is driven by the motor M in the direction opposite from that of the feed roller 22 in the fifth embodiment described above, the separation roller 23 may be constructed in other ways. For instance, the separation roller 23 may be constructed as shown in FIG. 19. That is, the separation roller 23 is provided with a spring 80, i.e., the following resilient member. The spring 80 elastically deforms as a sheet is conveyed and the separation roller 23 rotates in the same direction with the sheet conveying direction, and elastically restores when the sheet that has rotated the separation roller 23 is separated from the separation roller 23. This elastic restoring force rotates the separation roller 23 in the direction opposite from the sheet conveying direction. No motor that drives the separation roller 23 is required in this configuration.

This configuration will be specifically explained below. As shown in FIG. 19, the separation roller 23 is composed of an outer wheel 81 and an inner wheel 82 fixed to the body portion 11*a*, and is provided with the coiled spring 80 between the outer and inner wheels 81 and 82. A part of the spring 80 is fitted around the inner wheel 82 and one end of the spring 80 is anchored to an anchor portion 81*a* of the outer wheel 81. By constructing as described above, the part of the spring 80 is wound around the inner wheel 82 when the outer wheel 81 rotates in a predetermined direction, and the outer wheel 81 rotates with respect to the inner wheel 82 within a range of elastic deformation of the spring 80. When a torque rotating the outer wheel 81 is released, the outer wheel 81 rotates in the opposite direction by the elastic restoring force of the spring 80.

Specifically, when the sheet is conveyed by the feed roller 22 into the scanner 1, the sheet is nipped by the roller pair 31 and is conveyed further. When the sheet is conveyed by the roller pair 31, the trailing end side of the sheet is nipped by the feed roller 22 and the separation roller 23, and the separation roller 23 rotates in the same direction with the sheet conveying direction in conveying the sheet. At this time, the part of the spring 80 is wound around the inner wheel 82, and the outer wheel 81 rotates with respect to the inner wheel 82 within the range of the elastic deformation of the spring 80. Next, when the sheet passes through the nip portion of the feed roller 22 and the separation roller 23, the sheet is brought not in contact with the separation roller 23, and the torque that has rotated the separation roller 23 is released. Thereby, the spring 80 elastically restores and the outer wheel 81 rotates in the direction opposite from the direction in which the outer wheel 81 is rotated by the sheet corresponding to an elastic restoration amount of the spring 80.

At this time, a force acts on the sheet bundle on the tray 21 in contact with the separation roller 23 in a direction in which the sheet bundle returns on the tray 21 by the rotation of the separation roller 23. That is, the separation roller 23 rotates in the direction opposite from the sheet conveying direction by the elastic restoration force of the spring 80 and returns the sheet bundle in the direction opposite from the sheet conveying direction. As a result, a next sheet to be conveyed can be separated from the sheet bundle. Such configuration also prevents a part of the sheet from entering the gap G in returning the sheets by the separation roller 23 by providing the project member as described above.

Still further, although the sheet receiving member such as the intermediate plate 21*b* is pressed to the feed roller by the spring or the like in the fifth embodiment described above, it is also possible to arrange such that the sheet receiving member is fixed and the feed roller is biased to the sheet receiving member by a feed rotator bias means such as a spring. The feed rotator and the separation rotator that convey a sheet are not limited to be the feed roller and the separation roller, and may be constructed by other members such as a conveyor belt and a separation belt. The low friction member needs not be disposed at the leading end of the sheet receiving member and may be disposed at other parts such as an intermediate part of the sheet receiving member, as long as the low friction member faces the feed rotator and can nip the sheet with the feed rotator.

Sixth Embodiment

Figure 20:
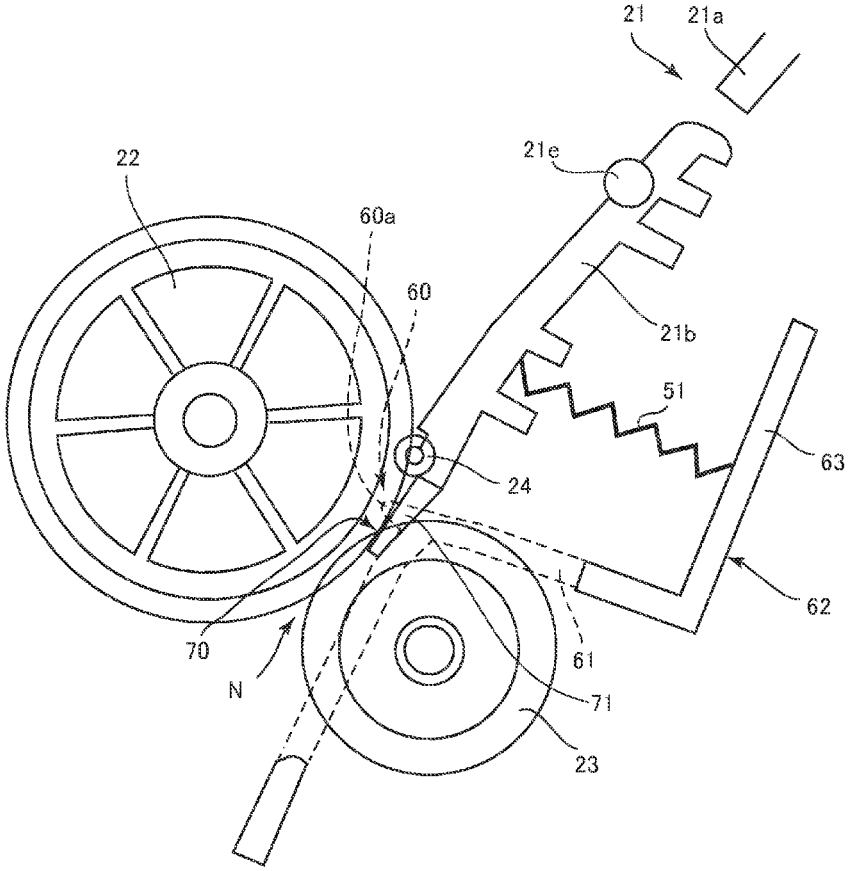
FIG. 20 is an enlarged schematic section view of a part corresponding to the part shown in FIG. 1 of a sheet conveying apparatus of a sixth embodiment of the invention.

A sixth embodiment of the invention will be explained with reference to FIG. 20. The present embodiment is what the first through fifth embodiments described above are combined. It is noted that the same applies to a case in which the second through fourth embodiments and the fifth embodiment are combined.

That is, similarly to the first embodiment, the abut portion 61 is provided with a restrict member 60 that partially projects to an opening side of the conveying path 13 such that the restrict member 60 restricts the sheet S stacked on the intermediate plate 21*b* from entering the conveying path (opening). The restrict members 60 are provided respectively in response to both ends of the nip portion N formed by the feed roller 22 and the separation roller 23. The restrict member 60 is also provided such that the restrict member 60 projects from the abut portion 61 and reaches to a position (at position not contacting with the feed roller) where the restrict member 60 is overlapped in the width direction orthogonal to the sheet conveying direction with the feed roller 22, i.e., the feed rotator, and where the restrict member 60 is offset in the width direction from the feed roller 22. In other words, the restrict member 60 overlaps partially with the feed roller 22 when viewed from the axial direction of the feed roller 22. That is, the restrict member 60 is overlapped with the feed roller 22. The restrict member 60 disposed as described above restricts the leading end position of the sheet stacked on the intermediate plate 21*b*.

Similarly also to the fifth embodiment, the project member 70 is provided from the front end of the intermediate plate 21*b* along the sheet conveying direction of the feed roller 22. That is, the project member 70 projects to the position where the project member 70 overlaps in the width direction orthogonal to the sheet conveying direction with the separation roller 23, i.e., the separation rotator, by passing through the gap G described above from the downstream end in the sheet conveying direction of the intermediate plate 21*b* and where the project member 70 is offset in the width direction from the separation roller 23. In other words, the project member 70 is overlapped with the separation roller 23. The project member 70 disposed as described above restricts the leading end position of the sheet stacked on the intermediate plate 21*b*.

The restrict member 60 and the project member 70 as described above are disposed such that they overlap with each other in the width direction orthogonal to the sheet conveying direction at least when the intermediate plate 21*b* is located in the feed position. That is, the restrict member 60 is overlapped with the project member 70 in the condition in which the intermediate plate 21*b* is moved to the feed position. It is noted that the restrict member 60 may be overlapped with the project member 70 also when the intermediate plate 21*b* is moved to the standby position depending on a travel of the intermediate plate 21*b* and on a positional relationship between the restrict member 60 and the abut portion 61.

The present embodiment described above brings about the following operations and effects in addition to the operations and effects brought about by the respective embodiments described above. That is, because the leading end of the sheet stacked on the intermediate plate 21*b* is restricted by the restrict member 60 and the project member 70, the sheet can be conveyed by the feed roller 22 more stably. For instance, there is a possibility that the leading end of the sheet enters the gap G between the intermediate plate 21*b* and the separation roller 23 when the leading end of the sheet stacked on the intermediate plate 21*b* in the standby position abuts against the abut portion 61 and the restrict member 60. In this case, it is possible to prevent the leading end of the sheet from entering the gap G if the project member 70 is formed from the intermediate plate 21*b* as described above.

There is also a possibility that the leading end of the sheet is caught in the gap G as the leading end of the sheet abuts against the abut portion 61 or the restrict member 60 when the intermediate plate 21*b* moves from the standby position to the feed position. It is possible to prevent the leading end of the sheet from entering the gap G also in this case if the project member 70 is formed from the intermediate plate 21*b* as described above. It is then possible to improve the separability of the sheet and to suppress the sheets otherwise fed in the layered condition by deflecting the sheet, whose leading end is guided by the project member 70, by the restrict member 60.

Still further, even if a part of the leading end of the sheet deflected by the restrict member 60 tries to enter the gap G, the project member 70 can prevent it from happening because the restrict member 60 is overlapped with the project member 70 in the feed position. That is, an imaginary corner portion is formed by the restrict member 60 and the project member 70 when viewed from the width direction as shown in FIG. 20. Accordingly, it is possible to guide the leading end of the sheet so as not enter the gap G, to improve the separability of the sheet by deflecting the sheet, and to improve the conveyance of the sheet further as a result.

Still further, when the pair of restrict elements 60*a* of the restrict member 60 is provided separately in the width direction as shown in FIG. 3 described above, it is preferable to provide the project element 71 of the project member 70 in the part of the separation roller 23 located in the widthwise center portion as shown in FIGS. 14 and 15. That is, when the pair of restrict elements 60*a* is provided separately in the width direction, a center part of a leading end of the sheet is prone to be deflected in a direction in which the center part projects to the gap G side because the leading end of the sheet comes into contact with and is guided by the pair of restrict elements 60*a*. Accordingly, if the project member 70 exists in the widthwise center part that projects due to the deflection, it is possible to prevent the center part of the sheet from entering the gap G due to the deflection, to prevent from jamming or the like from happening while improving the separability of the sheet, and to improve the conveyance of the sheet. The other configuration and operations of the present embodiment are the same with those of the respective embodiments described above.

INDUSTRIAL APPLICABILITY

The sheet conveying apparatus of the invention may be suitably used for a document information reading apparatus such as a scanner, and an image forming apparatus such as a copier, a printer, a facsimile machine and a multi-function printer.

REFERENCE SIGNS LIST

1 Scanner
11*a* Body portion (Case)
2 Sheet feeding portion (Sheet conveying apparatus)
21*b* Intermediate plate (Sheet receiving member)
22 Feed roller (Feed rotator)
23 Separation roller (Separation member, Separation rotator)
23*a* Roller element (Separation element)
24 Roller (Rotation member)
24*b* Small diameter portion (Rotational shaft)
3 Information reading portion
4 Discharge portion
60 Restrict member (Restricting portion)

60*a* Restrict element
61 Abut portion
70 Project member (Restrict portion)
71 Project element
80 Spring (Resilient member)
N Nip portion
S Sheet

The invention claimed is:

1. A sheet conveying apparatus, comprising:

a sheet receiving member on which a sheet is stacked;

a feed rotator configured to feed the sheet stacked on the sheet receiving member;

a separation member configured to separate the sheet from a sheet bundle stacked on the sheet receiving member;

a restrict portion disposed so as to reach a position where the restrict portion is overlapped in a width direction orthogonal to a sheet conveying direction of the feed rotator with at least one member among the feed rotator and the separation member and where the restrict portion is offset in the width direction from the one member, and restricting a leading end position of the sheet stacked on the sheet receiving member;

a moving portion that moves the sheet receiving member between a feed position where the sheet stacked on the sheet receiving member is bought into contact with the feed rotator and a standby position distant from the feed rotator more than the feed position; and an abut portion fixed to a case and disposed between the sheet receiving member and a nip portion formed by the feed rotator and the separation member such that a leading end of the sheet stacked on the sheet receiving member abuts against the abut portion in the standby position, wherein the separation member is a separation rotator which is disposed downstream of the sheet receiving member, in the sheet conveying direction, with a gap formed between the separation rotator and the sheet receiving member and is configured to come into contact and to form the nip portion with the feed rotator and to move the sheet in a direction opposite from the sheet conveying direction to separate the sheet one by one from the sheet bundle on the sheet receiving member, and wherein the restrict portion includes a restrict member disposed from the abut portion so as to reach a position where the restrict member is overlapped in the width direction orthogonal to the sheet conveying direction and where the restrict member is offset in the width direction from the feed rotator and configured to restrict a leading end position of the sheet to be conveyed; and a project member that projects from the downstream end of the sheet receiving member, in the sheet conveying direction, to a position where the project member is overlapped in the width direction with the separation rotator and where the project member is offset in the width direction from the separation rotator and configured to restrict a leading end position of the sheet stacked on the sheet receiving member.

2. The sheet conveying apparatus according to claim 1, wherein the restrict member has a pair of restrict elements provided by leaving a predetermined space therebetween in the width direction; and wherein a sheet whose width is smaller than the predetermined space is guided to the nip portion by passing through the space between the pair of restrict elements, and a sheet whose width is larger than the predetermined space is guided to the nip portion in contact with the pair of restrict elements.

3. The sheet conveying apparatus according to claim 2, wherein the pair of restrict elements is formed such that surfaces thereof facing with each other in the width direction are tapered in a direction in which the closer the front edge thereof, the wider the space becomes.

4. The sheet conveying apparatus according to claim 2, wherein the pair of restrict elements is disposed respectively on both sides in the width direction of the separation member.

5. The sheet conveying apparatus according to claim 1, wherein the restrict member and the project member are disposed so as to be overlapped in the width direction at least when the sheet receiving member is in the feed position.

6. The sheet conveying apparatus according to claim 1, wherein a surface of the restrict member against which a sheet stacked on the sheet receiving member abuts is formed continuously with a surface of the abut portion against which a sheet stacked on the sheet receiving member abuts.

7. The sheet conveying apparatus according to claim 1, wherein the restrict member has concave and convex portions formed along the width direction on a surface thereof against which the sheet stacked on the sheet receiving member abuts.

8. The sheet conveying apparatus according to claim 1, wherein the restrict member is provided with a rubber material on a surface thereof against which a sheet stacked on the sheet receiving member abuts such that a front edge thereof projects from the restrict member.

9. The sheet conveying apparatus according to claim 1, wherein the restrict member is formed such that an angle formed by a surface against which a sheet stacked on the sheet receiving member abuts and the sheet conveying direction is an obtuse angle.

10. The sheet conveying apparatus according to claim 1, wherein the separation rotator is composed of a plurality of separation elements; and wherein the project member is composed of a plurality of project elements formed such that the project elements project from the downstream end of the sheet receiving member, in the sheet conveying direction, to a gap between widthwise end surfaces of the plurality of separation elements and to positions adjacent to widthwise both ends of the separation rotator.

11. A sheet conveying apparatus, comprising:

a sheet receiving member on which a sheet is stacked;

a feed rotator configured to feed the sheet stacked on the sheet receiving member;

a separation member configured to separate the sheet from a sheet bundle stacked on the sheet receiving member; and a restrict portion disposed so as to reach a position where the restrict portion is overlapped in a width direction orthogonal to a sheet conveying direction of the feed rotator with at least one member among the feed rotator and the separation member and where the restrict portion is offset in the width direction from the one member, and restricting a leading end position of the sheet stacked on the sheet receiving member, wherein the separation member is a separation rotator which is disposed downstream of the sheet receiving member, in the sheet conveying direction with a gap formed between the separation rotator and the sheet receiving member and is configured to move the sheet in a direction opposite from the sheet conveying direction to separate the sheet one by one from the sheet bundle on the sheet receiving member; and wherein the restrict portion includes a project member that projects through the gap from the downstream end of the sheet receiving member, in the sheet conveying direction, to a position where the project member is overlapped in the width direction orthogonal to the sheet conveying direction with the separation rotator and where the project member is offset in the width direction from the separation rotator.

12. The sheet conveying apparatus according to claim 11, further comprising a drive source that rotationally drives the separation rotator in a direction opposite from the sheet conveying direction.

13. The sheet conveying apparatus according to claim 11, further comprising a resilient member that resiliently deforms when the separation rotator rotates in the same direction with the sheet conveying direction as a sheet is conveyed, is resiliently restored when the sheet that has rotated the separation rotator separates from the separation rotator, and rotates the separation rotator in a direction opposite from the sheet conveying direction by the resilient restoring force.

14. The sheet conveying apparatus according to claim 11, wherein the sheet receiving member is supported by a case such that the downstream end in the sheet conveying direction is rockable in a direction in which the sheet receiving member approaches to/separates from the feed rotator; and wherein the project member is formed such that the project member does not come into contact with the feed rotator regardless of the move of the sheet receiving member approaching to/separating from the feed rotator.

15. The sheet conveying apparatus according to claim 11, further comprising a rotary member rotatably supported at a position facing to the feed rotator of the sheet receiving member centering on a rotational shaft disposed in the width direction and configured to pinch a sheet with the feed rotator.

16. The sheet conveying apparatus according to claim 11, wherein the separation rotator is composed of a plurality of separation elements; and wherein the project member is composed of a plurality of project elements formed such that the project elements project from the downstream end of the sheet receiving member, in the sheet conveying direction, to a gap between widthwise end surfaces of the plurality of separation elements and to positions adjacent to widthwise both ends of the separation rotator.

17. The sheet conveying apparatus according to claim 11, wherein the sheet receiving member is provided such that own weight of a sheet on the sheet receiving member acts in a direction of approaching the separation rotator when the apparatus is in an operative condition.

* * * * *